US008131198B2

(12) United States Patent
Ishii et al.

(10) Patent No.: US 8,131,198 B2
(45) Date of Patent: Mar. 6, 2012

(54) IMAGE FORMING APPARATUS, FIXING UNIT, AND IMAGE FORMING METHOD WITH IMPROVED HEATING MECHANISM

(75) Inventors: Kenji Ishii, Kawasaki (JP); Keizo Yasuda, Kawasaki (JP); Akiyasu Amita, Yokohama (JP); Kenichi Hasegawa, Kawasaki (JP); Yasuhiro Kohira, Machida (JP); Yasutada Tsukioka, Kawasaki (JP); Masaya Shitami, Yokohama (JP); Satoshi Ueno, Kawasaki (JP)

(73) Assignee: Ricoh Co., Ltd., Tokyo (JP)

( * ) Notice: Subject to any disclaimer, the term of this patent is extended or adjusted under 35 U.S.C. 154(b) by 1067 days.

(21) Appl. No.: 11/485,395

(22) Filed: Jul. 13, 2006

(65) Prior Publication Data

US 2007/0014600 A1 Jan. 18, 2007

(30) Foreign Application Priority Data

Jul. 15, 2005 (JP) ..... 2005-207838

(51) Int. Cl.
*G03G 15/20* (2006.01)

(52) U.S. Cl. ..... 399/330; 399/67; 399/338

(58) Field of Classification Search ..... 399/336, 399/122, 67–70, 320, 328–330, 335, 338; 219/216, 244
See application file for complete search history.

(56) References Cited

U.S. PATENT DOCUMENTS

| | | | | |
|---|---|---|---|---|
| 4,114,021 | A * | 9/1978 | Nishide et al. | 219/216 |
| 6,442,366 | B1 * | 8/2002 | Hartley et al. | 399/336 |
| 6,872,925 | B2 * | 3/2005 | Asakura et al. | 219/619 |
| 7,031,648 | B2 | 4/2006 | Takashi et al. | |
| 7,058,329 | B2 | 6/2006 | Takahashi | |
| 7,194,233 | B2 * | 3/2007 | Wu et al. | 399/328 |
| 7,254,362 | B2 | 8/2007 | Kikuchi et al. | |
| 7,359,666 | B2 | 4/2008 | Takashi et al. | |
| 7,583,922 | B2 | 9/2009 | Takashi et al. | |
| 2005/0047838 | A1 * | 3/2005 | Uehara et al. | 399/329 |

FOREIGN PATENT DOCUMENTS

| | | |
|---|---|---|
| JP | 03-065167 | 6/1991 |
| JP | 08-083008 | 3/1996 |
| JP | 2000-089596 | 3/2000 |
| JP | 2000-182758 | 6/2000 |
| JP | 2000-206815 | 7/2000 |

(Continued)

OTHER PUBLICATIONS

Office Action dated Aug. 31, 2010 issued in corresponding Japanese Application No. 2005-207838.

(Continued)

*Primary Examiner* — David Porta
*Assistant Examiner* — Benjamin Schmitt
(74) *Attorney, Agent, or Firm* — Harness, Dickey & Pierce PLC

(57) ABSTRACT

An image forming apparatus includes an image forming mechanism to form a toner image on a recording medium according to image data and a fixing mechanism to fix the toner image on the recording medium. The fixing mechanism includes a fixing member and an external heater. The fixing member applies heat to the recording medium having the toner image. The external heater heats the fixing member and is formed in a shape corresponding to a surface of the fixing member. The external heater is disposed as if to engage and yet be spaced apart from the fixing member by a distance which is variable according to movement of the external heater.

24 Claims, 11 Drawing Sheets

FOREIGN PATENT DOCUMENTS

| | | |
|---|---|---|
| JP | 2000-299179 | 10/2000 |
| JP | 2001-175119 | 6/2001 |
| JP | 2001-343860 | 12/2001 |
| JP | 2002-123089 | 4/2002 |
| JP | 2002-289336 | 10/2002 |
| JP | 2002-311751 | 10/2002 |
| JP | 2003-076172 | 3/2003 |
| JP | 2004-054225 | 2/2004 |
| JP | 2004-055395 | 2/2004 |
| JP | 2004-101608 | 4/2004 |
| JP | 2004-145260 | 5/2004 |
| JP | 2004-233970 | 8/2004 |
| JP | 2004-239956 | 8/2004 |
| JP | 2004-258382 | 9/2004 |
| JP | 2004-341177 | 12/2004 |
| JP | 2005-043741 | 2/2005 |
| JP | 2005-157303 | 6/2005 |
| JP | 2005-164888 | 6/2005 |

OTHER PUBLICATIONS

Office Action dated Dec. 14, 2010 issued in corresponding Japanese Application No. 2005-207838.

* cited by examiner

IMAGE FORMING APPARATUS, FIXING UNIT, AND IMAGE FORMING METHOD WITH IMPROVED HEATING MECHANISM

PRIORITY STATEMENT

This application claims the priority of Japanese Patent Application No. 2005-207838, filed on Jul. 15, 2005, the disclosure of which is incorporated herein in its entirety by reference.

BACKGROUND

1. Technical Field

Example embodiments of the present invention generally relate to an image forming apparatus, a fixing unit, and/or an image forming method with an improved heating mechanism, e.g., for heating a fixing member to fix a toner image on a recording medium for example.

2. Description of Background Art

A background electrophotographic image forming apparatus, such as a copying machine, a printer, a facsimile machine, or a multifunction printer including copying, printing, and facsimile functions, generally forms an electrostatic latent image on a photoconductor according to image data. The electrostatic latent image is visualized with toner to form a toner image on the photoconductor. The toner image is transferred onto a sheet and the sheet having the toner image is conveyed to a fixing unit in which heat and pressure are applied to the sheet to fix the toner image on the sheet.

In such a fixing unit, a fixing member for applying heat to the sheet having the toner image needs to be heated to a fixing temperature in a shorter time period so as to enhance user-friendliness. Further, such fixing unit is desired to consume less power to save energy.

To cope with such needs, in an example background fixing unit, a fixing member is configured to have a thinner thickness (e.g., about 1 mm or less) to improve temperature response so as to be heated in a shorter time period. Power is supplied to a heater for heating the fixing member when an image forming operation starts while it is not supplied in a standby mode so as to save energy.

However, the fixing member having the thinner thickness has a small heat capacity and heat may be easily transferred to a sheet contacting the fixing member for fixing, resulting in an uneven temperature of the fixing member. To address this problem, another example background fixing unit is provided with a heat insulator for covering the fixing member to reduce heat radiation from the fixing member. However, the heat insulator may obstruct a quick heating of the fixing member.

To heat the fixing member in a shorter time period, yet another example background fixing unit is provided with an external heater disposed outside the fixing member and/or a heater disposed inside the fixing member to heat the fixing member. The external heater continuously contacts the fixing member or contacts and separates from the fixing member. However, the external heater contacting the fixing member may damage the fixing member.

SUMMARY

At least one embodiment of the present invention provides an image forming apparatus that includes an image forming mechanism to form a toner image on a recording medium according to image data and a fixing mechanism to fix the toner image on the recording medium. The fixing mechanism includes a fixing member and an external heater. The fixing member applies heat to the recording medium having the toner image. The external heater heats the fixing member and is formed in a shape corresponding to a surface of the fixing member. The external heater is disposed as if to engage and yet be spaced apart from the fixing member by a distance which is variable according to movement of the external heater.

At least one embodiment of the present invention provides a fixing unit for fixing a toner image on a recording medium. Such a fixing unit includes a fixing member and an external heater. The fixing member applies heat to the recording medium having the toner image. The external heater heats the fixing member and is formed in a shape corresponding to a surface of the fixing member. The external heater is disposed as if to engage and yet be spaced apart from the fixing member by a distance which is variable according to movement of the external heater.

At least one embodiment of the present invention provides a image forming method that includes forming a toner image on a recording medium according to image data and fixing the toner image on the recording medium. The fixing step includes sub-steps of disposing an external heater (formed in a shape corresponding to a surface of a fixing member) as if to engage and yet be spaced apart from the fixing member, moving the external heater to be a desired distance apart from the fixing member, heating the fixing member with the external heater, and applying heat to the recording medium having the toner image.

Additional features and advantages of the present invention will be more fully apparent from the following detailed description of example embodiments, the accompanying drawings and the associated claims.

BRIEF DESCRIPTION OF THE DRAWINGS

A more complete appreciation of the present invention and the many attendant advantages thereof will be readily obtained as the same becomes better understood by reference to the following detailed description of example embodiments when considered in connection with the accompanying drawings, wherein.

Figure 1:
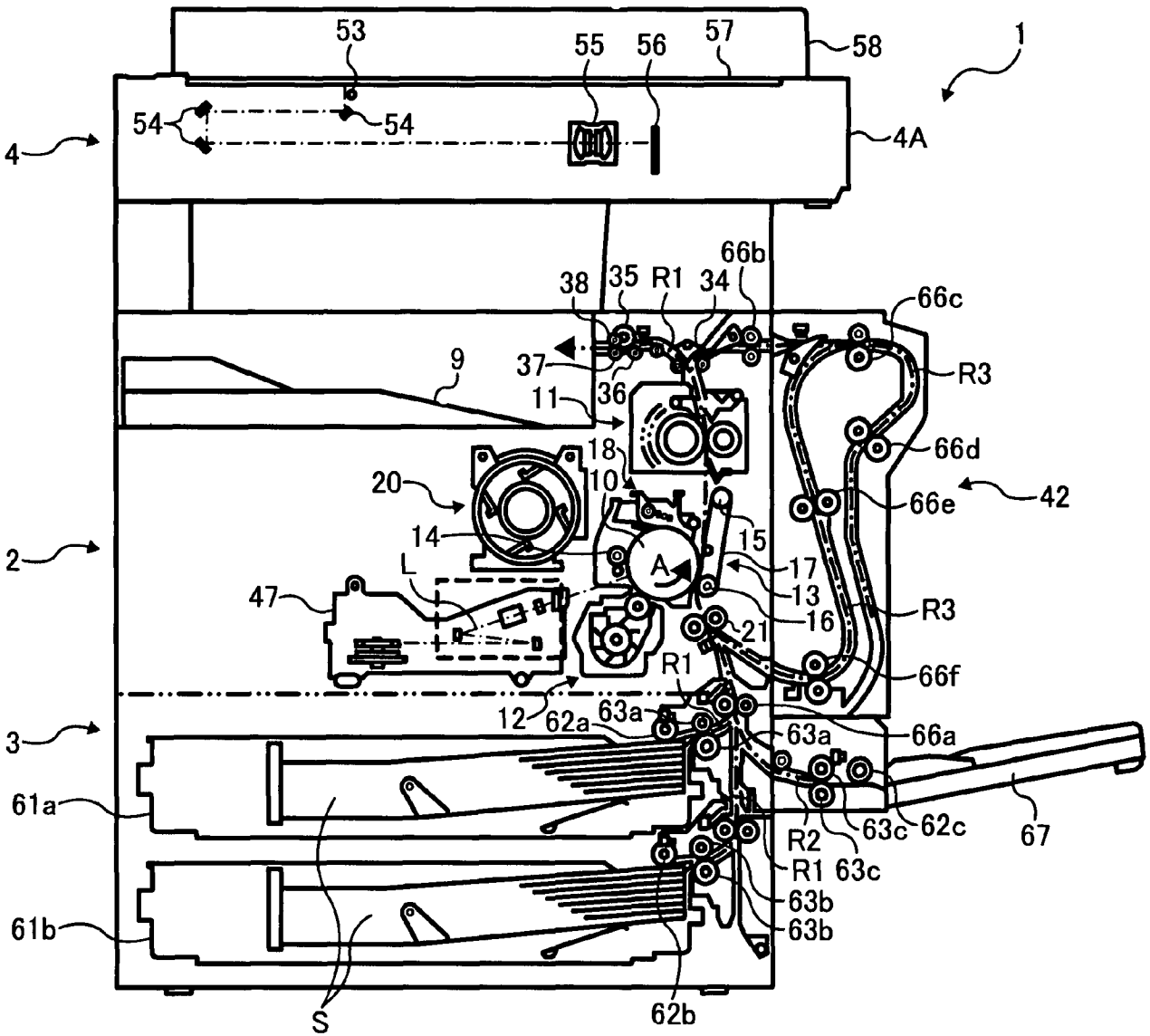
FIG. 1 is a schematic view of an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment of the present invention is explained.

As illustrated in FIG. 1, the image forming apparatus 1 includes a reader 4, a paper tray unit 3, a body 2, a conveyance path R1, and/or a duplex unit 42.

The image forming apparatus 1 includes a copying machine, a printer, a facsimile machine, a multifunction printer including copying, printing, and facsimile functions, or the like which forms an image on a recording medium (e.g., a sheet and an OHP (overhead projector) transparency) in an electrophotographic method. According to this example embodiment, the image forming apparatus 1 functions as a copying machine, e.g., a monochrome copying machine, for scanning an image on an original to create image data and forming a monochrome image on a sheet according to the image data.

The reader 4 is disposed on the body 2 and is configured to scan an image on an original to create image data and to send the image data to the body 2. Types of recording media other than, or in addition to, paper can be used. The paper tray unit 3 is disposed under the body 2 and is configured to load sheets S (i.e., the recording medium including the sheet and the OHP transparency) and to feed the sheets S one by one to the body 2. The body 2 is disposed on the paper tray unit 3 and is configured to perform image processing to form an image on the sheet S sent from the paper tray unit 3 according to the image data created by the reader 4. The conveyance path R1 is provided in the paper tray unit 3 and the body 2 to convey the sheet S in the paper tray unit 3 and the body 2. The conveyance path R1 mostly extends in a substantially vertical direction. The duplex unit 42 is configured to reverse the sheet S sent from the body 2 and to send back the sheet S to the body 2 for duplex copying.

The reader 4 includes an exposure glass cover 58 and/or a body 4A. The body 4A includes an exposure glass 57, a first traveler 53, second travelers 54, a lens 55, and/or a reading sensor 56.

The exposure glass 57 forms a part of a top of the body 4A. The exposure glass cover 58 has a larger size than the exposure glass 57 and is hinged on the top of the body 4A so as to be moved from a lowered position to a lifted position or from the lifted position to the lowered position. A user lifts the exposure glass cover 58 from the lowered position to the lifted position to place an original to be scanned onto the exposure glass 57. The user then lowers the exposure glass cover 58 so that the exposure glass cover 58 presses the original placed on the exposure glass 57. Thus, the original contacts the exposure glass 57 and is set flat on the exposure glass 57 in a state that an image on the original may be properly scanned.

When the user presses a start button on a control panel (not shown) of the image forming apparatus 1, the reader 4 starts scanning the image on the original. Specifically, a driving mechanism (not shown) moves the first traveler 53 and the second travelers 54. A light source of the first traveler 53 emits light onto the original. Mirrors of the second travelers 54 deflect the light reflected by the original toward the lens 55. The lens 55 irradiates the deflected light into the reading sensor 56. The reading sensor 56 converts the light into an electric signal to create image data.

The paper tray unit 3 includes paper trays 61*a* and 61*b*, a bypass tray 67, feeding rollers 62*a*, 62*b*, and 62*c*, separating roller pairs 63*a*, 63*b*, and 63*c*, the conveyance path R1, a conveyance path R2, and/or a feeding roller 66*a*.

The paper tray 61*a*, the paper tray 61*b*, and the bypass tray 67 load sheets S. The paper trays 61*a* and 61*b* are layered in the paper tray unit 3. The paper trays 61*a* and 61*b* may load sheets S different in size and orientation from each other. The paper tray 61*a* or 61*b* is automatically selected according to the size and orientation of the original placed on the exposure glass 57 or manually selected by the user according to the size and orientation the user has specified on the control panel. When the user presses the start button on the control panel, the feeding roller 62*a* or 62*b* rotates to feed an uppermost sheet S of the sheets S loaded on the paper tray 61*a* or 61*b*. The separating roller pair 63*a* or 63*b* separates the uppermost sheet S from other sheet S when a plurality of sheets S is fed by the feeding roller 62*a* or 62*b* and feeds only the uppermost sheet S toward the conveyance path R1. The feeding roller 66*a* feeds the sheet S conveyed through the conveyance path R1 up toward the body 2.

The bypass tray 67 may load sheets S including thick paper, a postcard, and an OHP transparency. When the sheets S are placed on the bypass tray 67, the bypass tray 67 is automatically selected. When the user presses the start button on the control panel, the feeding roller 62*c* rotates to feed an uppermost sheet S of the sheets S loaded on the bypass tray 67. The separating roller pair 63*c* separates the uppermost sheet S from other sheet S when a plurality of sheets S is fed by the feeding roller 62*c* and feeds only the uppermost sheet S toward the conveyance path R2. The feeding roller 66*a* feeds the sheet S conveyed through the conveyance path R2 up toward the body 2.

The body 2 includes a registration roller 21, a photoconductor 10, a charger 14, an exposure unit 47, a development unit 12, a transferor 13, a cleaning unit 18, a toner container 20, a fixing unit 11, a switching nail 34, feeding rollers 35, 36, 37, and 38, an output tray 9, and/or a feeding roller 66*b*.

The sheet S fed by the feeding roller 66*a* stops when contacting the registration roller 21.

The photoconductor 10 is formed in a drum shape (e.g., a cylindrical shape) and is rotatably supported by a shaft extending in a horizontal direction so as to rotate in a rotating direction A. A driver (not shown) including a motor drives the photoconductor 10 to rotate in the rotating direction A at a constant speed.

The charger 14, the development unit 12, the transferor 13, the cleaning unit 18, and a discharger (not shown) are disposed around the photoconductor 10 in this order in the rotating direction A. The exposure unit 47 is disposed obliquely downward of the photoconductor 10. Charging, exposing, developing, transferring, cleaning, and discharging positions are formed in this order in the rotating direction A on a surface of the photoconductor 10 in accordance with the charger 14, the exposure unit 47, the development unit 12, the transferor 13, the cleaning unit 18, and the discharger disposed as described above.

The charger 14 uniformly charges the surface of the photoconductor 10 at the charging position. The exposure unit 47 emits light L (e.g., laser beam) onto the exposing position to form an electrostatic latent image on the surface of the photoconductor 10 according to the image data. The development unit 12 includes a toner brush (not shown) carrying toner particles and visualizes the electrostatic latent image at the developing position with the toner particles of the toner brush to form a toner image.

The transferor 13 includes a support roller 15, a support roller 16, and/or a transfer belt 17. The support rollers 15 and 16 oppose each other in a state that a distance is provided between the support rollers 15 and 16 in a substantially vertical direction. The transfer belt 17 is looped over the support rollers 15 and 16. The registration roller 21 starts rotating to feed the sheet S to the transferor 13 at a timing when the toner image formed on the surface of the photoconductor 10 is properly transferred onto the sheet S. As a result, the toner image is transferred onto the sheet S at the transferring position while the sheet S is conveyed on the transfer belt 17. The transfer belt 17 conveys the sheet S having the toner image up toward the fixing unit 11. Namely, a portion of the support roller 16, over which the transfer belt 17 is looped, presses the photoconductor 10 via the transfer belt 17 to form the transferring position between the surface of the photoconductor 10 and an outer circumferential surface of the transfer belt 17. The support roller 15 is disposed near the fixing unit 11.

The cleaning unit 18 includes a blade (not shown), a brush (not shown), or both of the blade and the brush for removing contaminants including residual toner particles not transferred and remaining on the surface of the photoconductor 10. The blade includes an edge for pressingly contacting the surface of the photoconductor 10 at the cleaning position. The brush contacts the surface of the photoconductor 10 at the cleaning position and is driven to rotate in accordance with rotation of the photoconductor 10.

The discharger includes a lamp for emitting light. The lamp emits light onto the surface of the photoconductor 10 at the discharging position to discharge the surface of the photoconductor 10 so that the surface potential of the photoconductor 10 is restored to an initial level.

The toner container 20 contains unused toner particles and includes a toner bottle. A toner supplying path (not shown) is provided between the toner container 20 and the development unit 12. The unused toner particles are supplied from the toner container 20 to the development unit 12 when the development unit 12 has an insufficient quantity of toner particles after using the toner particles for visualizing the electrostatic latent image formed on the surface of the photoconductor 10.

As described above, when the user presses the start button on the control panel, the photoconductor 10 starts rotating so that the toner image is formed on the surface of the photoconductor 10 according to the image data. Namely, while the photoconductor 10 rotates, a portion on the surface of the photoconductor 10 passes the charging, exposing, developing, transferring, cleaning, and discharging positions formed on the surface of the photoconductor 10 in accordance with the charger 14, the exposure unit 47, the development unit 12, the transferor 13, the cleaning unit 18, and the discharger. An image forming operation is performed in a cycle including charging, exposing, developing, transferring, cleaning, and discharging. The cycle is repeated to form another toner image within a suitable distance along the outer circumferential surface of the photoconductor 10 in the rotating direction A according to the size of the toner image to be formed.

In the fixing unit 11, heat and pressure are applied to the sheet S to fix the toner image on the sheet S. The sheet S having the fixed toner image is fed toward the switching nail 34. The switching nail 34 guides the sheet S through the conveyance path R1 toward the feeding rollers 35, 36, 37, and 38. The feeding rollers 35, 36, 37, and 38 feed the sheet S onto the output tray 9 disposed in an upper portion of the body 2.

When the user has selected duplex copying, the switching nail 34 guides the sheet S toward the feeding roller 66*b*. The feeding roller 66*b* feeds the sheet S toward the duplex unit 42.

The duplex unit 42 includes the feeding rollers 66*c*, 66*d*, 66*e*, and 66*f* and/or a reverse conveyance path R3. The feeding roller 66*c* feeds the sheet S through the reverse conveyance path R3 toward the feeding roller 66*d*. Then, the feeding rollers 66*d* and 66*c* feed the sheet S back toward the feeding roller 66*e*. The feeding roller 66*e* feeds the sheet S through the reverse conveyance path R3 toward the feeding roller 66*f*. The feeding roller 66*f* feeds the sheet S toward the registration roller 21. The registration roller 21 feeds the sheet S toward the transferor 13. In the transferor 13, a toner image is transferred onto the other side of the sheet S and the sheet S having the toner image is fed toward the fixing unit 11. In the fixing unit 11, the toner image on the other side of the sheet S is fixed and the sheet S having the fixed toner image is fed toward the feeding rollers 35, 36, 37, and 38. The feeding rollers 35, 34, 37, and 38 feed the sheet S onto the output tray 9.

Figure 2:
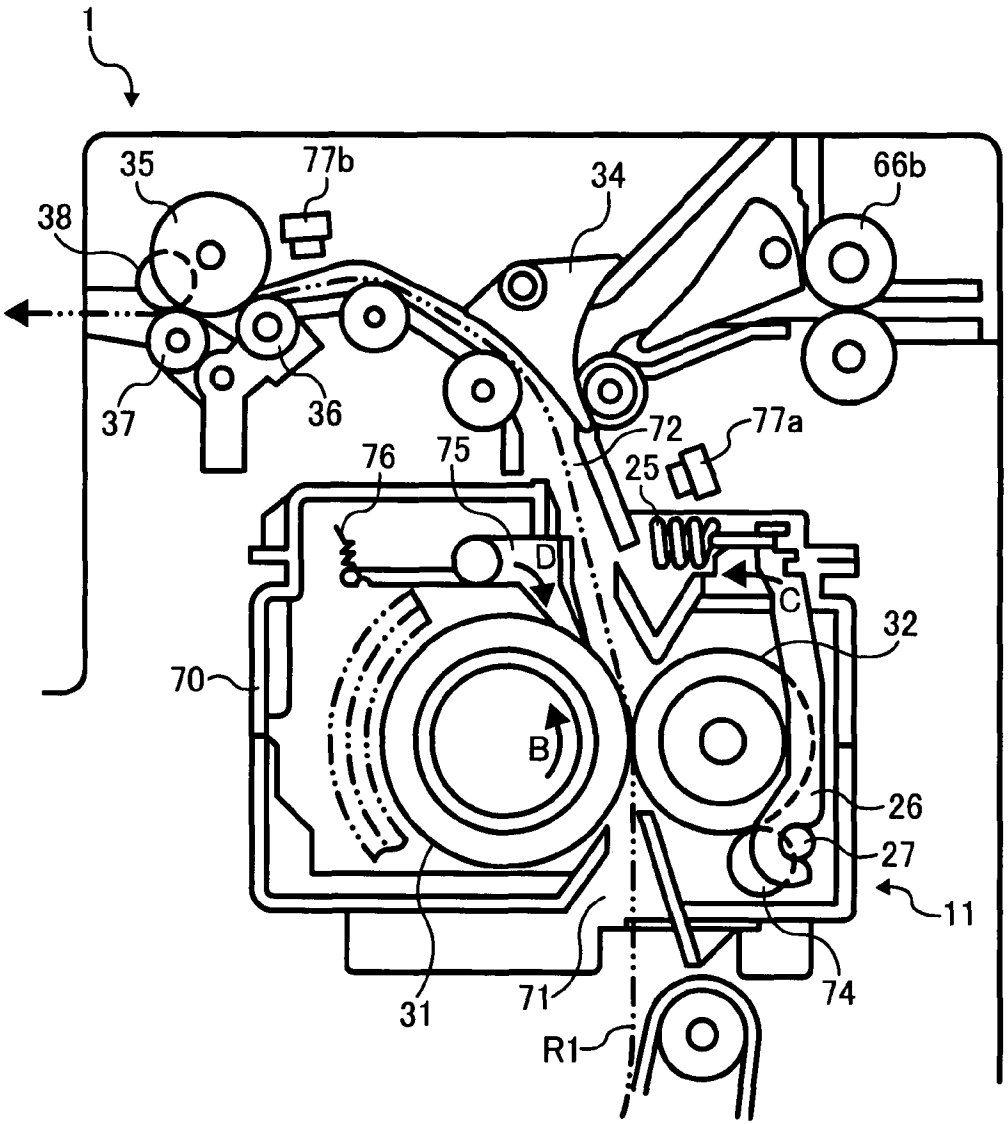
FIG. 2 is a more detailed schematic view (according to an example embodiment of the present invention) of a fixing unit and peripheral elements of the image forming apparatus shown in FIG. 1.

As illustrated in FIG. 2, the fixing unit 11 includes a housing 70, a heating roller 31, a pressure roller 32, a pressing lever 26, a support axis 27, a spring 25, a cleaner 74, a separating nail 75, and/or spring 76. The image forming apparatus 1 further includes paper jam sensors 77*a* and 77*b*.

The housing 70 forms an outer case covering elements of the fixing unit 11 and rotatably supports a shaft of the heating roller 31 horizontally extended. The heating roller 31 functions as a fixing member for applying heat to a sheet S having a toner image. The housing 70 also rotatably supports the pressure roller 32. The pressure roller 32 and the heating roller 31 oppose each other forms substantially horizontal direction in a state that the pressure roller 32 pressingly contacts the heating roller 31. A nip formed between the heating roller 31 and the pressure roller 32 opposing each other forms a fixing position where heat and pressure are applied to the sheet S having the toner image which is conveyed through the nip formed between the heating roller 31 and the pressure roller 32. The toner image formed on the sheet S is melted and fixed onto the sheet S.

The heating roller 31 is formed in a cylindrical shape. The housing 70 rotatably supports heating roller 31 in a state that the heating roller 31 extends in a substantially horizontal direction. A driver (not shown) including a motor drives and rotates the heating roller 31 in a rotating direction B at a constant speed. Specifically, bearings (not shown) rotatably support the shaft of the heating roller 31 and an axis of rotation is fixed in the housing 70.

The pressure roller 32 is formed in a cylindrical shape and has a diameter smaller than the diameter of the heating roller 31. The pressure roller 32 is disposed to oppose the heating roller 31 in the substantially horizontal direction. The housing 70 rotatably supports the pressure roller 32 in a state that the pressure roller 32 extends in the substantially horizontal direction and is movable toward the heating roller 31. A force is applied to the pressure roller 32 to press the pressure roller 32 toward the heating roller 31.

Specifically, bearings (not shown) support the pressure roller 32 in a manner that the pressure roller 32 is movable toward the heating roller 31 within a suitable range. The pressing lever 26 presses the pressure roller 32 toward the heating roller 31.

The pressing lever 26 is formed in a shape extending for a length in a substantially vertical direction. The support axis 27 is fixed to the housing 70 and swingably supports a lower end of the pressing lever 26. An upper end of the pressing lever 26 is connected with one end of the spring 25. The other end of the spring 25 is fixed to the housing 70 in a state that the spring 25 is stretched to have a length longer than its natural length. Thus, a tension of the spring 25 applies a force for rotating the pressing lever 26 in a rotating direction C around the support axis 27. A middle portion of the pressing lever 26 pressingly contacts the pressure roller 32 to move the pressure roller 32 toward the heating roller 31. Thus, the pressure roller 32 constantly contacts the heating roller 31 with a pressure.

The housing 70 includes an entrance 71 and/or an exit 72. The entrance 71 is provided in a lower portion of the housing 70 and forms an opening formed in a slit-like shape, through which the sheet S is conveyed into the fixing unit 11 on the conveyance path R1. The exit 72 is provided in an upper portion of the housing 70 and forms an opening formed in a slit-like shape, through which the sheet S is conveyed out of the fixing unit 11 on the conveyance path R1. Thus, a path extending from the entrance 71 to the exit 72 via the nip formed between the heating roller 31 and the pressure roller 32 (i.e., a fixing position) is formed as a part of the conveyance path R1 in the housing 70.

The cleaner 74 includes a cleaning member (e.g., a cleaning roller) which contacts the pressure roller 32 and is driven by the pressure roller 32 to rotate to clean an outer circumferential surface of the pressure roller 32 after a fixing operation is performed. Namely, the cleaning member of the cleaner 74 removes contaminants including toner particles and paper dust adhered to the outer circumferential surface of the pressure roller 32 from the sheet S conveyed in the fixing unit 11 for the fixing operation.

The separating nail 75 pressingly contacts an outer circumferential surface of the heating roller 31 to prevent the sheet S from wrapping around the heating roller 31. The separating nail 75 is formed in a substantially L-like shape and includes a middle portion, a head, and a base. The housing 70 rotatably supports the middle portion. The head is disposed to contact the outer circumferential surface of the heating roller 31 at a position which is downstream of the nip formed between the heating roller 31 and the pressure roller 32 and upstream of the exit 72 in a sheet conveyance direction. The base is connected to an end of the spring 76 which is stretched. A tension of the spring 76 applies a force for rotating the separating nail 75 in a rotating direction D.

The paper jam sensors 77*a* and 77*b* are disposed near the conveyance path R1 to detect a paper jam. The paper jam sensors 77*a* and 77*b* include an optical sensor capable of detecting a jammed sheet S without contacting the sheet S. Each of the paper jam sensors 77*a* and 77*b* detects an area on the conveyance path R1. Each of the paper jam sensors 77*a* and 77*b* detects the sheet S which is conveyed in the area on the conveyance path R1 to locate the jammed sheet S when the sheet S stops.

A temperature sensor (not shown) is disposed near the heating roller 31. The temperature sensor contacts or does not contact the surface of the heating roller 31 to detect a temperature of the surface of the heating roller 31. While the image forming apparatus 1 is powered on, the temperature sensor constantly detects the temperature of the surface of the heating roller 31. Thus, the temperature of the surface of the heating roller 31 may be controlled based on the detected temperature.

Figure 3:
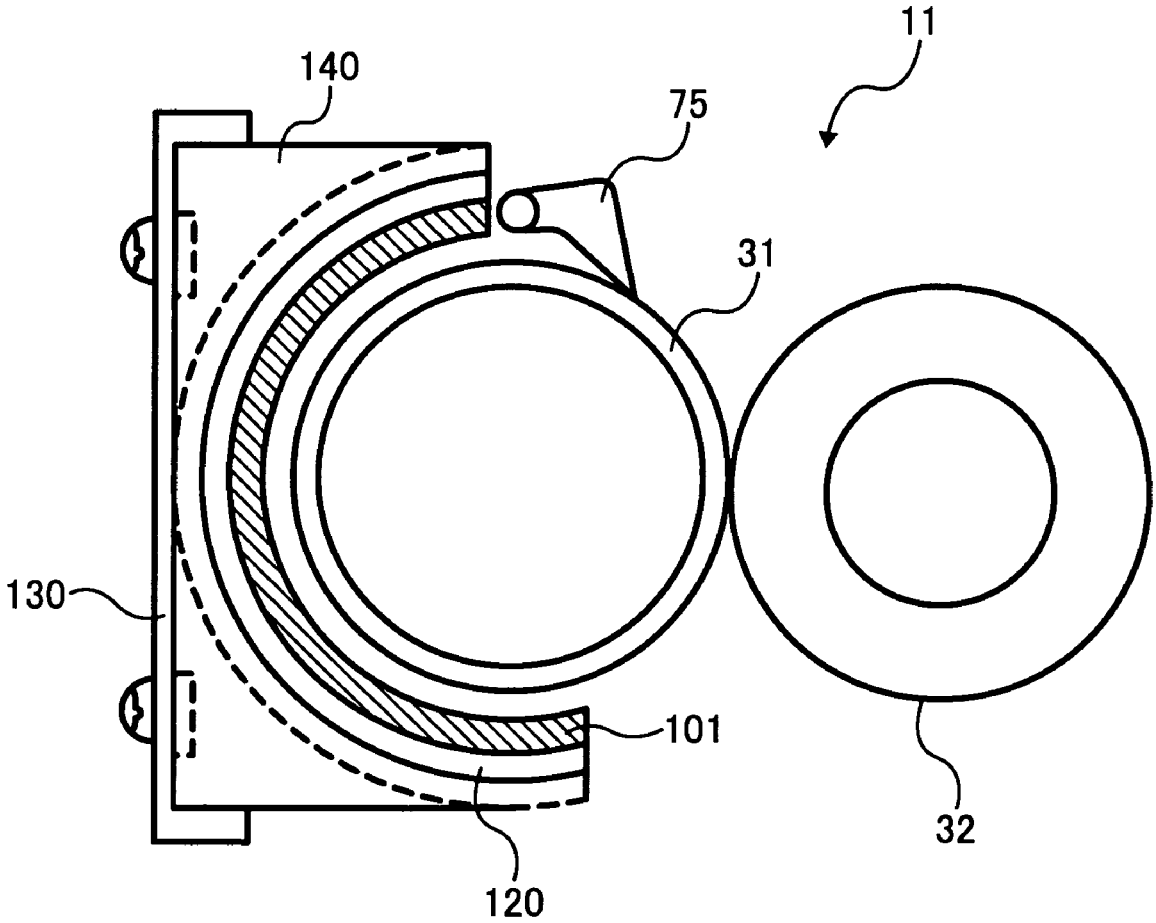
FIG. 3 is a more detailed schematic view (according to an example embodiment of the present invention) of the fixing unit shown in FIG. 2.

As illustrated in FIG. 3, the fixing unit 11 further includes an external heater 101, a movable housing 130, a resin member 140, and/or a heat insulator 120.

The external heater 101 is disposed along the outer circumferential surface of the heating roller 31 to form a concave-like shape with respect to the outer circumferential surface of the heating roller 31 with a distance (or gap) provided between the external heater 101 and the heating roller 31. The external heater 101 may contact or may not contact the heating roller 31.

Basically, the external heater 101 is deformed in a shape with which the external heater 101 is disposed along the outer circumferential surface of the heating roller 31. Specifically, the external heater 101 deformed in the above-described shape is disposed between the movable housing 130 and the heating roller 31. Further, the external heater 101 is selectively movable between a contact position at which the external heater 101 contacts the heating roller 31 and a non-contact position at which the external heater 101 does not contact the heating roller 31 within an area formed between the movable housing 130 and the heating roller 31 while the external heater 101 maintains the above-described shape.

The resin member 140 is attached to the movable housing 130. The external heater 101 is fixed to the resin member 140 via the heat insulator 120. Specifically, the movable housing 130 includes a frame of a sufficient stiffness and may be disposed inside the housing 70 forming the outer case of the fixing unit 11. The resin member 140 includes a plastic material and is fixed to the movable housing 130. For example, the resin member 140 is formed in a plate-like shape and a circumferential edge of the resin member 140 facing the heating roller 31 is formed in an arc-like shape which forms a concave-like shape portion with respect to the outer circumferential surface of the heating roller 31. Thus, the external heater 101 is fixed to the circumferential edge of the resin member 140 via the heat insulator 120. A plurality of the resin members 140 are arranged in a longitudinal direction of a shaft of the heating roller 31 in a state that a distance is provided between the adjacent resin members 140.

The heat insulator 120 and the external heater 101 are formed in a shape with which outer circumferential surfaces of the heat insulator 120 and the external heater 101 are disposed along the circumferential edge of the resin member 140 and inner circumferential surfaces of the heat insulator 120 and the external heater 101 are disposed along the outer circumferential surface of the heating roller 31. The heat insulator 120 and the external heater 101 are formed in the arc-like shape which forms the concave-like shape portion with respect to the outer circumferential surface of the heating roller 31. The external heater 101 is fixed to the resin member 140 via the heat insulator 120 in a state that the external heater 101 includes a concave-like shape portion corresponding to a convex-like shape of the outer circumferential surface of the heating roller 31 facing the external heater 101.

Figure 4A:
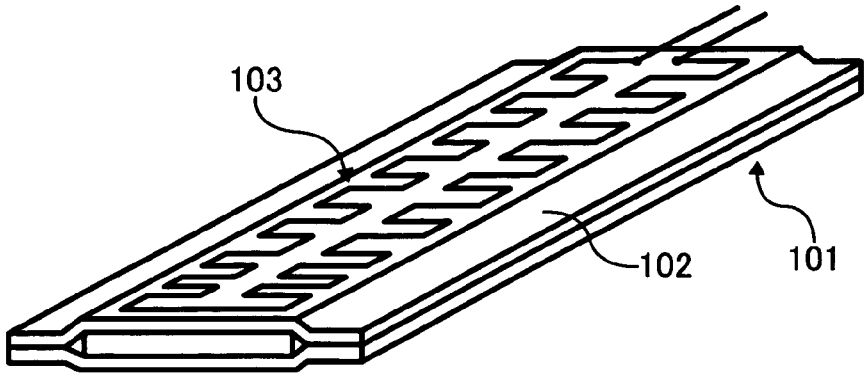
FIG. 4A is a perspective view (according to an example embodiment of the present invention) of an external heater for the fixing unit shown in FIG. 3.

As illustrated in FIG. 4A, the external heater 101 includes a heat-resistant resin sheet 102 and/or a heat generator 103. The heat generator 103 is buried in the heat-resistant resin sheet 102 including a polyimide film having a sufficient heat resistance capable of resisting a fixing temperature. The heat-resistant resin sheet 102 is formed in a substantially rectangular, sheet-like shape having a thickness in a range of from about 0.5 mm to about 1.0 mm at least before the heat-resistant resin sheet 102 is fixed in the fixing unit 11. The heat generator 103 includes an electrode and an external terminal crimped to the electrode. Specifically, the external terminal is connected to the electrode by crimping. The external terminal is wired to a power source (not shown) of the fixing unit 11 or the image forming apparatus 1. Thus, power needed for the heat generator 103 to generate heat is supplied to the heat generator 103.

The heat generator 103 may be formed in a sheet-like shape or a linear shape. The heat generator 103 having the sheet-like shape is disposed in an entire surface of the heat-resistant resin sheet 102. The heat generators 103 having the linear shape are arranged in linear groups in the heat-resistant resin sheet 102.

The heat generator 103 is a heater configured to have a preset resistance corresponding to the fixing temperature. The temperature of the heat generator 103 may increase up to a temperature regulated by the preset resistance. Therefore, the heat generator 103 does not need a thermostat, a thermal fuse, or a temperature controller for controlling the temperature of the heat generator 103. Thus, electrical elements needed for controlling the temperature of the heat generator 103 may be reduced in the image forming apparatus 1. The image forming apparatus 1 may have a simpler structure with fewer elements, providing cost reduction and improved maintenance and reliability.

FIG. 4A illustrates an example wiring of the heat generator 103 having the sheet-like shape in which heat is simultaneously generated in the entire heat generator 103. As illustrated in FIG. 4A, the heat generator 103 includes one heat generating wire. The heat generating wire serpentines in one half of the heat-resistant resin sheet 102 in a width direction of the heat-resistant resin sheet 102 along a longitudinal direction of the heat-resistant resin sheet 102, turns around and serpentines back in the opposite direction in the other half of the heat-resistant resin sheet 102 in the width direction of the heat-resistant resin sheet 102 along the longitudinal direction of the heat-resistant resin sheet 102 for the above-described length. The external terminals are crimped to both ends of the heat generating wire and power is supplied to the heat generating wire via the external terminals.

Figure 4B:
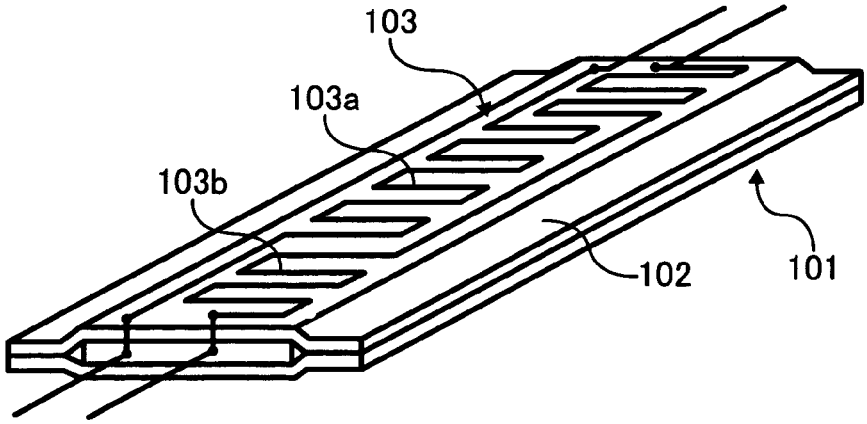
FIG. 4B is a perspective view (according to an example embodiment of the present invention) of another external heater for the fixing unit shown in FIG. 3.

FIG. 4B illustrates an example wiring of the heat generator 103 having the linear shape in which heat is generated in a center portion and both end portions of the heat generator 103 in the longitudinal direction of the heat-resistant resin sheet 102. The both end portions of the heat generator 103 oppose each other via the center portion. Heat may be generated in the center portion or in the center portion and the both end portions of the heat generator 103.

As illustrated in FIG. 4B, the heat generator 103 includes heat generating wires 103*a* and/or 103*b* for independently carrying an electric current. The heat generating wire 103*a* serpentines by using an almost full width in the width direction of the heat-resistant resin sheet 102 in the center portion of the heat-resistant resin sheet 102 in the longitudinal direction of the heat-resistant resin sheet 102. The heat generating wire 103*a* extends straight in one half of the heat-resistant resin sheet 102 in the width direction of the heat-resistant resin sheet 102 along the longitudinal direction of the heat-resistant resin sheet 102 in both end portions of the heat-resistant resin sheet 102 in the longitudinal direction of the heat-resistant resin sheet 102.

The heat generating wire 103*b* serpentines by using the almost full width in the width direction of the heat-resistant resin sheet 102 in the both end portions of the heat-resistant resin sheet 102 in the longitudinal direction of the heat-resistant resin sheet 102. The heat generating wire 103*b* extends straight in the other half of the heat-resistant resin sheet 102 in the width direction of the heat-resistant resin sheet 102 along the longitudinal direction of the heat-resistant resin sheet 102 in the center portion of the heat-resistant resin sheet 102 in the longitudinal direction of the heat-resistant resin sheet 102. The external terminals are crimped to both ends of each of the heat generating wires 103*a* and 103*b* and power is independently supplied to each of the heat generating wires 103*a* and 103*b* via the external terminals. Therefore, the heat generating wires 103*a* and 103*b* are neither overlapped nor crossed on the heat-resistant resin sheet 102. The heat generating wire 103*a* generates heat in the center portion of the heat-resistant resin sheet 102 in the longitudinal direction of the heat-resistant resin sheet 102. The heat generating wire 103*b* generates heat in the both end portions of the heat-resistant resin sheet 102 in the longitudinal direction of the heat-resistant resin sheet 102.

According to the example wiring of the heat generator 103 illustrated in FIG. 4B, the heat generating area of the external heater 101 may be switched between two heated areas in accordance with the size of a sheet S conveyed into the fixing unit 11. Specifically, when the fixing unit 11 fixes a toner image on a small size sheet S, e.g., only the heat generating wire 103*a* is selected to generate heat to heat the center portion of the heat-resistant resin sheet 102 in the longitudinal direction of the heat-resistant resin sheet 102. Thus, an electric current may be supplied to the heat generating wire 103*a* only, resulting in reduced power consumption. When the fixing unit 11 fixes a toner image on a large size sheet S, an electric current is supplied to both of the heat generating wires 103*a* and 103*b* so that the heat generating wires 103*a* and 103*b* may generate heat to simultaneously heat the center portion and the both end portions of the heat-resistant resin sheet 102 in the longitudinal direction of the heat-resistant resin sheet 102.

The heat generating area of the external heater 101 may be divided into more than two areas to cope with various sheet sizes. Namely, the heat generating area of the external heater 101 may be divided into multiple areas in accordance with the size of sheets S which further vary depending on the orientation of the sheets S. When the heat generating area of the external heater 101 is divided into multiple areas, the heat generating area may be changed in accordance with the size of the sheet S, resulting in further reduced power consumption. The heat generating area may be more precisely adjusted to match with the size of the sheet S. An electric current may not be supplied to the heat generating wire provided in the area which is not used for fixing, resulting in further reduced power consumption.

As illustrated in FIG. 3, the heat insulator 120 contacts and covers an outer circumferential surface of the external heater 101, which does not face the heating roller 31. The heat insulator 120 covers the entire outer circumferential surface of the external heater 101. Namely, the outer circumferential surface of the external heater 101 is not exposed. Thus, heat generated by the external heater 101 may be effectively transferred to the heating roller 31. Specifically, the heat insulator 120 blocks heat generated by the external heater 101, transferring the heat in a direction to move away from the heating roller 31. Exposure of other components to heat radiation from the outer circumferential surface of the external heater 101 accordingly may be reduced if not prevented. The heat generated by the external heater 101 may be mostly directed to the heating roller 31 and may effectively heat the heating roller 31.

Figure 5:
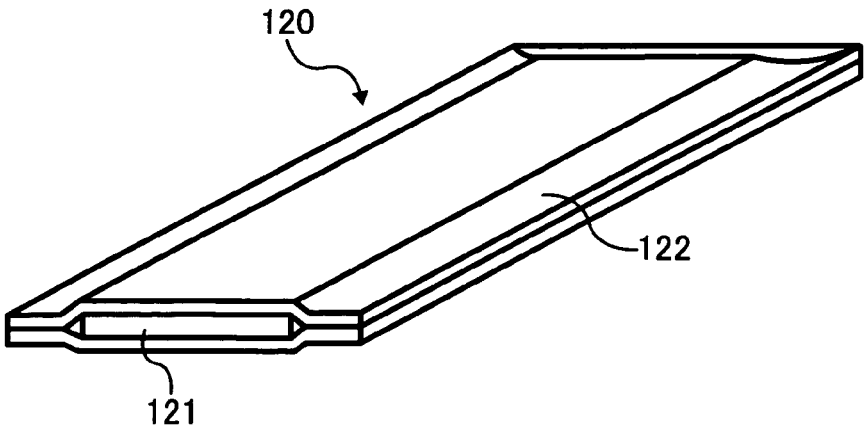
FIG. 5 is a perspective view (according to an example embodiment of the present invention) of a heat insulator of the fixing unit shown in FIG. 3.

As illustrated in FIG. 5, the heat insulator 120 includes a core 121 and/or a cover 122. The cover 122 includes a laminated film. Covering the core 121 with the cover 122 in vacuum produces the heat insulator 120. The core 121 includes a porous material (e.g., urethane foam) and/or a powder material (e.g., silica). The core 121 is sealed under an environment having a vacuum in a range of from about 1 Pa to about 200 Pa. The core 121 includes a material having a strength enduring an atmospheric pressure of an environment. The core 121 does not have a solid structure but has a porous structure including a plenty of cells and includes the porous material (e.g., urethane foam) which may be flexibly deformed.

Otherwise, the core 121 has a porous structure including gaps between powder particles. The core 121 is formed in a plate-like shape having dimensions substantially common to outside dimensions of the external heater 101. The core 121 may be flexibly deformed in a thickness direction. The cover 122 may endure a difference between the vacuum and the atmospheric pressure and is formed in a thin film-like shape having a gas barrier property capable of blocking transmission of outside air. Covering and sealing the core 121 with the cover 122 in vacuum produces the heat insulator 120. Inner space of the heat insulator 120 not occupied by the core 121 is vacuum. Namely, the entire inner space of the heat insulator 120 is uniformly vacuum.

Heat insulation effectiveness of the heat insulator 120 depends on heat insulation of the vacuum space rather than on the heat insulation property of the materials. Therefore, the heat insulator 120 may have a thinner, lighter structure while having a sufficient heat insulation property. The thinner heat insulator 120 may be disposed in the limited space in the fixing unit 11 by occupying a reduced space. Thus, the fixing unit 11 need not have a large size, saving space in the image forming apparatus 1.

The heat insulator 120 having the vacuum structure contacts the outer circumferential surface of the external heater 101 which does not face the heating roller 31. Thus, the heat insulator 120 may block heat transferred from the outer circumferential surface of the external heater 101 on a shortest route to an interior wall of the movable housing 130. Heat radiated from an inner circumferential surface of the external heater 101 which faces the heating roller 31 is transferred to the heating roller 31 and is blocked by the heating roller 31. Thus, the heat insulator 120 may effectively insulate heat.

The heat insulator 120 has an increased flexibility because the cover 122 formed in the thin film-like shape covers the core 121 including the urethane foam which easily bends and/or the fluid powder material. The heat insulator 120 may be deformed in accordance with the outer circumferential surface of the external heater 101 while having the vacuum structure. The heat insulator 120 may uniformly contact the outer circumferential surface of the external heater 101 without an air space formed between the heat insulator 120 and the external heater 101, providing high heat insulation effectiveness. The heat insulator 120 may uniformly provide the high heat insulation effectiveness on the entire outer circumferential surface of the external heater 101. Therefore, high heat radiation effectiveness may also be provided uniformly between the external heater 101 and the heating roller 31.

Figure 6A:
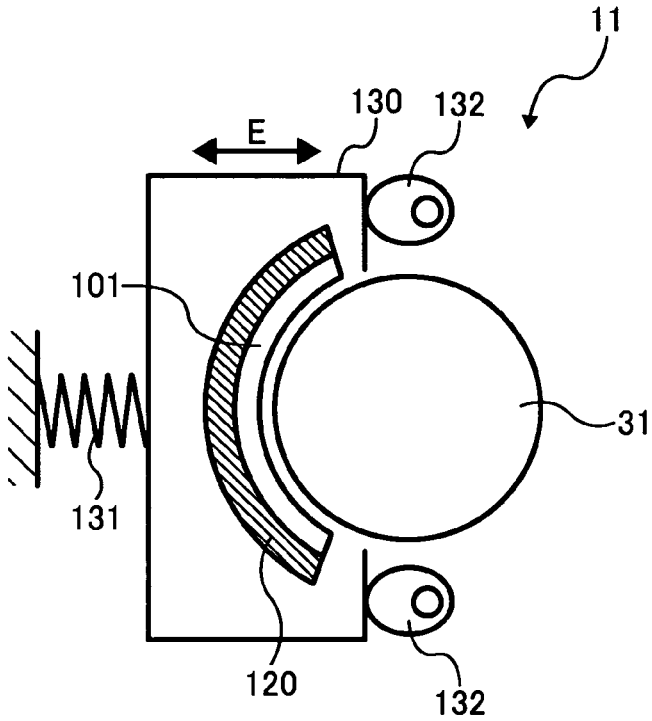
FIG. 6A is a schematic view (according to an example embodiment of the present invention) of an external heater separated from a heating roller of the fixing unit shown in FIG. 3.

As illustrated in FIG. 6A, the fixing unit 11 further includes a spring 131 and/or rollers 132. The spring 131 applies a force moving the movable housing 130 holding the external heater 101 toward the heating roller 31. A motor (not shown) drives and rotates the rollers 132 to move the external heater 101 away from the heating roller 31 against the force applied by the spring 131.

Specifically, a guide (not shown) supports or holds the movable housing 130 holding the external heater 101 in a manner that the movable housing 130 may move in directions E. The compressed spring 131 is disposed to contact the movable housing 130 in a state that a free end of the spring 131 contacts a back outer surface of the movable housing 130 which does not face the heating roller 31 but faces an opposite direction of the heating roller 31. A resilient restoration force of the spring 131 presses the back outer surface of the movable housing 130 to move the movable housing 130 holding the external heater 101 toward the heating roller 31.

The rollers 132 are disposed to contact the movable housing 130 in a state that outer circumferential surfaces of the rollers 132 contact a front outer surface of the movable housing 130 disposed in an opposite side of the back outer surface. The rollers 132 may rotate for an arbitrary angle. Each of the rollers 132 is formed in an oval-like shape and includes a core disposed to deviate from a center of the oval and a shaft fixed to the core. A motor (not shown) rotates the shaft in both clockwise and counterclockwise directions for an arbitrary angle. The rollers 132 rotate for an arbitrary angle, and then stop. A distance for which the rollers 132 protrude toward the movable housing 130 may vary depending on the arbitrary angle. Positions at which the outer circumferential surfaces of the rollers 132 contact the front outer surface of the movable housing 130 move in the directions E within a length determined based on a difference between longest and shortest diameters of the rollers 132. As a result, the external heater 101 held by the movable housing 130 may arbitrarily contact and separate from the heating roller 31.

An actuator for driving the rollers 132 in a rotating direction and/or a driver for driving the rollers 132 in protruding and receding directions may move the movable housing 130 holding the external heater 101 to adjust the distance for which the rollers 132 protrude toward the movable housing 130. The actuator may include a motor and the driver may include a solenoid for contacting the movable housing 130 to move the movable housing 130 by pushing and pulling the movable housing 130.

As described above, a distance between the movable housing 130 and the heating roller 31 may be changed by setting an angle for which the rollers 132 rotate. Namely, the external heater 101 held by the movable housing 130 may move for a length corresponding to the above-described distance with respect to the heating roller 31 for rotating in a state that an axis of the heating roller 31 is fixed. Thus, a distance between the external heater 101 and the heating roller 31 may be arbitrarily changed. The distance between the external heater 101 and the heating roller 31 may be zero, that is, the external heater 101 may contact the heating roller 31.

To fix a toner image on a sheet S, the heating roller 31 rotates and applies heat to the sheet S having the toner image. Therefore, the external heater 101 recedes to a position where the external heater 101 does not contact the rotating heating roller 31 as illustrated in FIG. 6A and thereby may not damage the heating roller 31. Radiant heat is transferred from the external heater 101 to the heating roller 31 to heat the heating roller 31 cooled after heat is transferred from the heating roller 31 to the sheet S. Thus, while the toner image on the sheet S is fixed, the external heater 101 supplies heat to the heating roller 31 in an amount at least sufficient to retrieve heat transferred from the heating roller 31 to the sheet S for fixing the toner image on the sheet S.

Figure 6B:
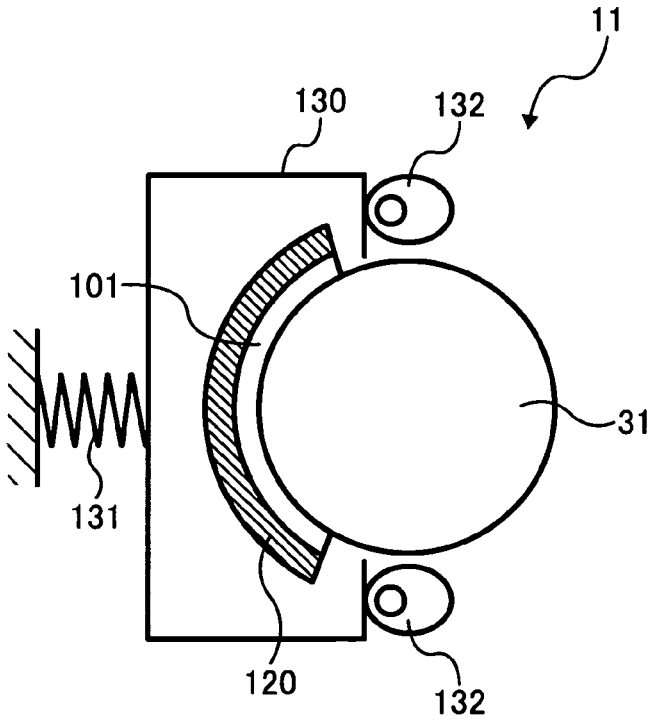
FIG. 6B is a schematic view (according to an example embodiment of the present invention) of the external heater contacting the heating roller shown in FIG. 6A.

After the fixing operation is finished, the heating roller 31 stops rotating in a standby mode for waiting for a next fixing operation. The heating roller 31 is used to maintain a certain temperature in the standby mode. The external heater 101 contacts the heating roller 31 as illustrated in FIG. 6B after the heating roller 31 stops rotating so that heat is directly transferred from the external heater 101 to the heating roller 31. The external heater 101 moves to contact the heating roller 31 to obtain a high heat transfer efficiency.

As described above, according to this example embodiment, heat may be effectively transferred from the external heater 101 to the heating roller 31 in a state that the external heater 101 does not contact the heating roller 31. As a result, warm-up of the heating roller 31 may be finished in a shortened time period. The heating roller 31 may not be cooled down immediately after the warm-up is finished. The external heater 101 may not damage the outer circumferential surface of the heating roller 31.

Specifically, while the heating roller 31 stops rotating before the warm-up is finished, the external heater 101 contacts the heating roller 31, providing the high heat transfer efficiency and shortening the warm-up time period. When the toner image on the sheet S is fixed immediately after the warm-up is finished, that is, when the sheet S having the toner image is conveyed through the nip formed between the heating roller 31 and the pressure roller 32, heat is transferred from the external heater 101 which is disposed along the outer circumferential surface of the heating roller 31 with a distance provided between the external heater 101 and the heating roller 31 so that the external heater 101 does not contact the heating roller 31. Heat may be effectively transferred from the external heater 101 to the heating roller 31 when heat is transferred from the heating roller 31 to the sheet S for fixing. Thus, the heating roller 31 may not be cooled down when the sheet S is conveyed through the nip formed between the heating roller 31 and the pressure roller 32 immediately after the warm-up of the heating roller 31 is finished. Heat is transferred from the external heater 101 to the heating roller 31 in a state that the external heater 101 does not contact the heating roller 31. The outer circumferential surface of the heating roller 31 may not wear due to the contact of the external heater 101 to the heating roller 31, resulting in an improved endurance of the heating roller 31. The external heater 101, from which heat may be effectively transferred, may have a compact size and save space in the fixing unit 11.

The fixing unit 11 includes the movable housing 130 for holding the external heater 101, resulting in easier assembly and maintenance of the fixing unit 11. Specifically, the external heater 101 may be installed into the fixing unit 11 after the external heater 101 is attached to the movable housing 130. The external heater 101 may be deformed. The resin member 140 is attached to the movable housing 130 and the external heater 101 is attached to the movable housing 130 via the resin member 140. Even when the external heater 101 is not molded into the above-described shape, the resin member 140 deforms the external heater 101 when the external heater 101 is attached to the movable housing 130. Thus, a manufacturing process for deforming the external heater 101 may not be needed. When the external heater 101 has a failure, the movable housing 130 holding the external heater 101 may be removed from the fixing unit 11 and the movable housing 130 holding a new external heater 101 may be installed into the fixing unit 11. Thus, the elements of the fixing unit 11 may be easily replaced, resulting in an improved maintenance of the fixing unit 11.

According to this example embodiment, the external heater 101 contacts the heating roller 31 when the heating roller 31 stops and separates from the heating roller 31 when the heating roller 31 moves. Namely, when the heating roller 31 stops, the external heater 101 contacts the heating roller 31 to effectively transfer heat from the external heater 101 to the heating roller 31 contacted thereto. When the heating roller 31 moves, the external heater 101 separates from the heating roller 31 to prevent the external heater 101 from damaging the outer circumferential surface of the heating roller 31. Thus, heat may be effectively transferred from the external heater 101 to the heating roller 31. As a result, the warm-up time of the heating roller 31 may be shortened and the heating roller 31 may not be cooled down immediately after the warm-up of the heating roller 31 is finished. Further, the external heater 101 may not damage the outer circumferential surface of the heating roller 31.

Figure 7A:
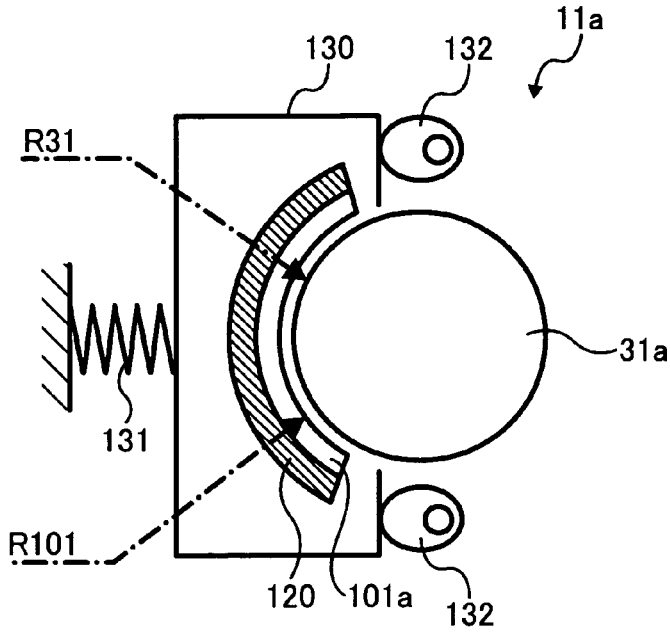
FIG. 7A is a schematic view of an external heater separated from a heating roller of a fixing unit according to an example embodiment of the present invention.
Figure 7B:
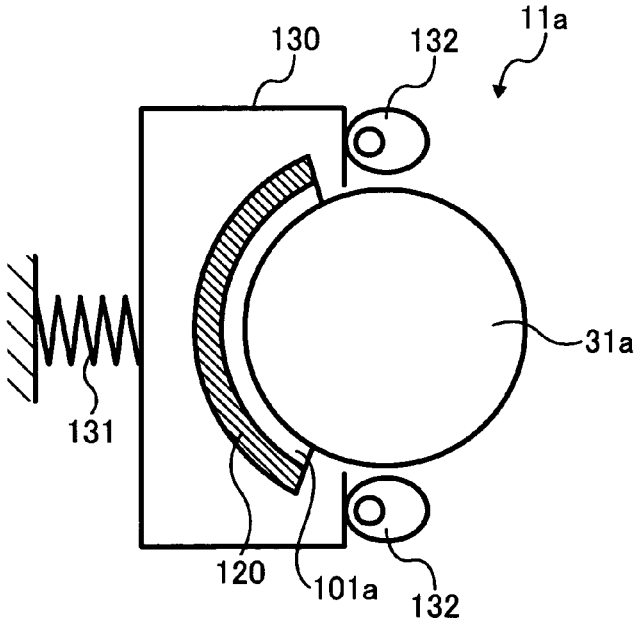
FIG. 7B is a schematic view of the external heater contacting the heating roller shown in FIG. 7A.

FIGS. 7A and 7B illustrate a fixing unit 11*a* according to another example embodiment of the present invention. As illustrated in FIG. 7A, the fixing unit 11*a* includes a heating roller 31*a* and an external heater 101*a* respectively replacing the heating roller 31 and the external heater 101 of the fixing unit 11. The other elements of the fixing unit 11*a* are common to the fixing unit 11. The fixing unit 11*a* is configured to provide higher heat transfer efficiency than the fixing unit 11 when the external heater 11*a* contacts the heating roller 31*a*.

The heating roller 31*a* functions as a fixing member for applying heat to a sheet S having a toner image. The external heater 101*a* may contact and separate from the heating roller 31*a*. When the heating roller 31*a* stops rotating and the external heater 101*a* contacts the heating roller 31*a*, heat is effectively and rapidly transferred from the external heater 101*a* to the heating roller 31*a*. However, when an air space is provided between the external heater 101*a* and the heating roller 31*a*, heat transfer efficiency may substantially decrease even if the air space is small. In addition, the temperature of an outer circumferential surface of the heating roller 31*a* may vary depending on whether the air space is provided between the external heater 101*a* and the heating roller 31*a* or not. Namely, the temperature of the outer circumferential surface of the heating roller 31*a* which contacts the external heater 101*a* may differ from the temperature of the outer circumferential surface of the heating roller 31*a* which does not contact the external heater 101*a*, causing temperature variations. As a result, the outer circumferential surface of the heating roller 31*a* may be easily damaged.

To solve the above-described problems, an inner circumferential surface of the external heater 101*a*, which contacts the outer circumferential surface of the heating roller 31*a*, is formed in a concave-like shape (e.g., an arc-like shape when the heating roller 31*a* is formed in a roller-like shape) which fits to a convex-like shape of the outer circumferential surface of the heating roller 31*a*. Thus, the inner circumferential surface of the external heater 101*a* uniformly contacts the outer circumferential surface of the heating roller 31*a*. Specifically, a radius R101 forming the concave-like shape of the external heater 101*a* has a length common to a radius R31 forming the convex-like shape of the heating roller 31*a*. When the external heater 101*a* contacts the heating roller 31*a*, the inner circumferential surface of the external heater 101*a* entirely contacts the outer circumferential surface of the heating roller 31*a*. The inner circumferential surface of the external heater 101*a* which faces the heating roller 31*a* is formed in a shape corresponding to the shape of the outer circumferential surface of the heating roller 31*a*. The shapes of the inner circumferential surface of the external heater 101*a* and the outer circumferential surface of the heating roller 31*a* cause the external heater 101*a* to contact the heating roller 31*a* with no space provided between the external heater 101*a* and the heating roller 31*a*.

As illustrated in FIG. 7B, when the external heater 101*a* contacts the heating roller 31*a*, the entire inner circumferential surface of the external heater 101*a* may uniformly contact the outer circumferential surface of the heating roller 31*a* with no small air space partially created between the external heater 101*a* and the heating roller 31*a*. Thus, heat transfer efficiency may not decrease due to the air space, resulting in improved heating efficiency of the external heater 101*a*. The outer circumferential surface of the heating roller 31*a* may be uniformly heated and the temperature of the outer circumferential surface of the heating roller 31*a* may not vary, resulting in improved endurance of the heating roller 31*a*.

As described above, according to this example embodiment, the fixing unit 11*a* may provide effects similar to the effects provided by the fixing unit 11 according to a previous example embodiment. Further, when the heating roller 31*a* stops rotating, the external heater 101*a* contacts the heating roller 31*a* by using its entire inner circumferential surface with no air space provided between the external heater 101*a* and the heating roller 31*a*. The heating roller 31*a* may be heated by utilizing the entire contacted surfaces of the external heater 101*a* and the heating roller 31*a*. The temperature of the external heater 101*a* and the heating roller 31*a* may not vary on the contacted surfaces. Thus, heat may be effectively transferred from the external heater 101*a* to the heating roller 31*a*.

According to this example embodiment, the heating roller 31*a* is formed in the convex-like shape with respect to the inner circumferential surface of the external heater 101*a* and the external heater 101*a* is formed in the concave-like shape with respect to the outer circumferential surface of the heating roller 31*a*. The external heater 101*a* and the heating roller 31*a* contact each other in a state that the contacted surfaces of the external heater 101*a* and the heating roller 31*a* form the common arc-like shape. When the heating roller 31*a* stops, the external heater 101*a* and the heating roller 31*a* may contact each other to form the contacted surfaces as large as possible. Thus, heat may be effectively and uniformly transferred from the external heater 101*a* to the heating roller 31*a* without causing varied temperatures of the outer circumferential surface of the heating roller 31*a*.

Figure 8:
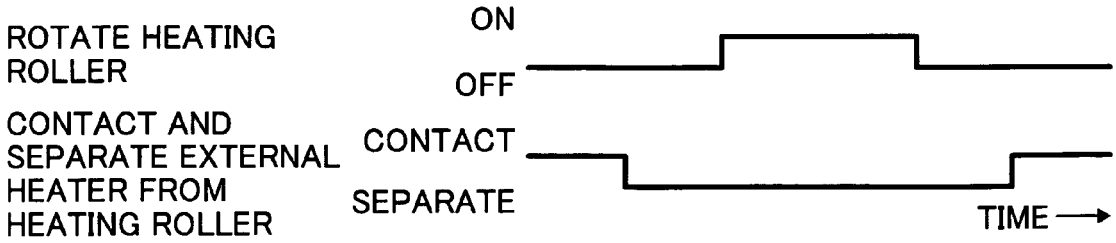
FIG. 8 is a timing chart of operations of an external heater and a heating roller of a fixing unit according to an example embodiment of the present invention.

FIG. 8 illustrates a timing chart for controlling the heating roller 31*a* and the external heater 101*a* according to yet another example embodiment of the present invention. According to this example embodiment, whether the heating roller 31*a* is rotated or not is detected. The external heater 101*a* a contacts the heating roller 31*a* after the heating roller 31*a* stops rotating and the external heater 101*a* separates from the heating roller 31*a* before the heating roller 31*a* starts rotating, based on the detection.

Specifically, a motor (not shown) for driving and rotating the heating roller 31*a* rotates and stops in accordance with a rotating signal. A motor (not shown) for contacting and separating the external heater 101*a* to and from the heating roller 31*a* is controlled to operate in association with the rotating signals.

As illustrated in FIG. 8, a signal voltage of the rotating signal for controlling the heating roller 31*a* is switched between low and high states to rotate and stop the motor for driving and rotating the heating roller 31*a*. The signal voltage in the low state indicates an ON signal for starting and continuing rotating the motor. The signal voltage in the high state indicates an OFF signal for stopping rotating the motor.

The external heater 101*a* contacts and separates from the heating roller 31*a* in accordance with a contacting-separating signal. A signal voltage of the contacting-separating signal is switched between low and high states to rotate and stop the motor for contacting and separating the external heater 101*a* to and from the heating roller 31*a*. The signal voltage in the low state indicates an On signal for rotating the motor forward. The signal voltage in the high state indicates an OFF signal for rotating the motor backward for a length which may be determinable and/or determined.

A timing to start separating the external heater 101*a* from the heating roller 31*a*, which is indicated with an edge signal of the contacting-separating signal switching from the high state to the low state, is set to a timing which is for a time period F earlier than a timing to start rotating the heating roller 31*a*, which is indicated with an edge signal of the rotating signal switching from the low state to the high state. On the other hand, a timing to start contacting the external heater 101*a* to the heating roller 31*a*, which is indicated with an edge signal of the contacting-separating signal switching from the low state to the high state, is set to a timing which is delayed for a time period G from a timing to stop rotating the heating roller 31*a*, which is indicated with an edge signal of the rotating signal switching from the high state to the low state.

The timing to start separating the external heater 101*a* from the heating roller 31*a* may be controlled by setting the timing to start rotating the heating roller 31*a* and outputting the edge signal for starting separating the external heater 101*a* from the heating roller 31*a* at the timing which is for the time period F prior to the timing to start rotating the heating roller 31*a*. Otherwise, the timing to start separating the external heater 101*a* from the heating roller 31*a* may be controlled by setting the timing to start separating the external heater 101*a* from the heating roller 31*a* and outputting the edge signal for starting rotating the heating roller 31*a* at the timing which is for the time period F delayed from the timing to start separating the external heater 101*a* from the heating roller 31*a*. The timing to start contacting the external heater 101*a* to the heating roller 31*a* may be controlled by outputting the edge signal for starting contacting the external heater 101*a* to the heating roller 31*a* at the timing which is delayed for the time period G from the timing to stop rotating the heating roller 31*a*.

The time period F is configured to be equivalent to or longer than a time period needed for the external heater 101*a*, which contacts the heating roller 31*a*, to separate from the heating roller 31*a*. The time period G is configured to be equivalent to or longer than a time period needed for the rotating heating roller 31*a* to completely stop rotating.

The external heater 101*a* contacts the heating roller 31*a* after the heating roller 31*a* stops rotating and separates from the heating roller 31*a* before the heating roller 31*a* starts rotating. Therefore, damage caused by friction between the moving external heater 101*a* and the rotating heating roller 31*a* may be reduced if not prevented. The external heater 101*a* contacts and separates from the heating roller 31*a* while the heating roller 31*a* completely stops. Thus, the external heater 101*a* and the heating roller 31*a* may not move in a relatively oblique direction to each other, reducing if not preventing abrasion on the outer circumferential surface of the heating roller 31*a* and maintaining the smooth outer circumferential surface of the heating roller 31*a*. The smooth outer circumferential surface of the heating roller 31*a* may provide proper fixing of a toner image on a sheet S, resulting in forming a high quality image on the sheet S. The damage on the outer circumferential surface of the heating roller 31*a* may be reduced if not prevented, resulting in an improved endurance of the heating roller 31*a*.

To control the external heater 101*a* and the heating roller 31*a* to operate as described above, a control circuit (not shown) may be provided in the fixing unit 11*a*. Otherwise, a controller (not shown) of the image forming apparatus 1 may be utilized. The control circuit and the controller may be connected to various sensors and switches used for controlling the external heater 101*a* and the heating roller 31*a* to obtain signals from the sensors and switches. The control circuit and the controller may also be connected to the external heater 101*a* and the heating roller 31*a* to send commands to the external heater 101 and the heating roller 31*a*.

As described above, this example embodiment may provide effects similar to the effects provided according to the previous example embodiment. Further, the outer circumferential surface of the heating roller 31*a* may not be damaged even if the external heater 101*a* contacts and separates from the heating roller 31*a*. The external heater 101*a* neither contacts nor separates from the heating roller 31*a* while the heating roller 31*a* rotates. Namely, the external heater 101*a* and the heating roller 31*a* do not move simultaneously. Sufficient time periods are provided before the external heater 101*a* contacts the heating roller 31*a* after the heating roller 31*a* stops rotating and before the heating roller 31*a* starts rotating after the external heater 101*a* separates from the heating roller 31*a*, allowing a mechanical error and preventing simultaneous movement of the external heater 101*a* and the heating roller 31*a*. Thus, abrasion, which may occur on the outer circumferential surface of the heating roller 31*a* when the external heater 101*a* and the heating roller 31*a* contact each other while simultaneously moving, may be reduced if not prevented. As a result, the outer circumferential surface of the heating roller 31*a* may be maintained in a proper condition, providing high fixing performance.

According to this example embodiment, the external heater 101*a* contacts the heating roller 31*a* after the heating roller 31*a* stops rotating and separates from the heating roller 31*a* before the heating roller 31*a* starts rotating, reducing if not preventing abrasion on the outer circumferential surface of the heating roller 31*a* caused by friction between the external heater 101*a* and the rotating heating roller 31*a* contacting each other.

The following describes yet another example embodiment of the present invention. According to this example embodiment, the external heater 101*a* contacts the heating roller 31*a* when the image forming apparatus 1 is powered off. Specifically, a force applied (e.g., the spring 131) pushes the external heater 101*a* toward the heating roller 31*a*. A driver (e.g., a motor for driving the external heater 101*a*) applies a force to separate the external heater 101*a* from the heating roller 31*a*. When the image forming apparatus 1 is powered off, the force for separating the external heater 101*a* from the heating roller 31*a* is released to contact the external heater 101*a* to the heating roller 31*a*.

When the image forming apparatus 1 is powered on after powered off (e.g., when the image forming apparatus 1 is warmed up), the external heater 101*a* operates after power is supplied to all devices provided in the image forming apparatus 1. Before the external heater 101*a* contacts the heating roller 31*a*, a time period for sending a signal to the driver of the external heater 101*a* and a time period for moving the external heater 101*a* to the heating roller 31*a* are needed, lengthening a warm-up time of the heating roller 31*a*.

If the external heater 101*a* is configured to contact the heating roller 31*a* in an initial state (e.g., when the image forming apparatus 1 is powered on), the heating roller 31*a* may be heated in a short time period, shortening the warm-up time of the heating roller 31*a*. Specifically, when the image forming apparatus 1 is powered off, the driver for driving the external heater 101*a* is powered off and the external heater 101*a* contacts the heating roller 31*a*. Therefore, when the image forming apparatus 1 is powered on again (e.g., when the warm-up starts), the external heater 101*a* contacts the heating roller 31*a*.

Thus, the time period for sending a signal to the driver of the external heater 101*a* and the time period for moving the external heater 101*a* to the heating roller 31*a* may be reduced or eliminated, resulting in a shorter warm-up time of the heating roller 31*a*. In other words, when the image forming apparatus 1 is powered off, the driver of the external heater 101*a* does not drive the external heater 101*a* or reduces its driving force resisting the spring 131 to a level which causes the external heater 101*a* to contact the heating roller 31*a*. A force (e.g., an elastic force) of the spring 131 moves the external heater 101*a* (i.e., the movable housing 130 holding the external heater 101*a*) toward the heating roller 31*a* so that the external heater 101*a* contacts the heating roller 31*a*.

As described above, this example embodiment may provide effects similar to the effects provided according to the previous example embodiment. Further, when the image forming apparatus 1 is powered on again after powered off, power supply to the external heater 101*a* immediately starts to heat the external heater 101*a*. Heat may be directly transferred from the external heater 101*a* to the heating roller 31*a*, shortening a first warm-up time for heating the heating roller 31*a* from a room temperature to a fixing temperature.

When the image forming apparatus 1 is powered on again after the image forming apparatus 1 is powered off and the temperature of the heating roller 31*a* decreases to the room temperature, the heating roller 31*a* may be heated in a short time period, shortening the warm-up time of the heating roller 31*a*. Even when the image forming apparatus 1 is powered on early in the morning when the room temperature is substantially low, for example, the heating roller 31*a* may be heated in a short time period. As a result the image forming apparatus 1 waits for the heating roller 31*a* to be warmed up for the short time period, providing an improved user convenience.

According to this example embodiment, when the image forming apparatus 1 is powered off, the external heater 101*a* moves to contact the heating roller 31*a*. Namely, the external heater 101*a* is controlled to contact the heating roller 31*a* in the initial state in which the image forming apparatus 1 is powered off. Thus, when the image forming apparatus 1 is powered on again, power is immediately supplied to the external heater 101*a* so that the external heater 101*a* generates heat. The generated heat may be directly transferred from the external heater 101*a* to the heating roller 31*a* contacted thereto, shortening the warm-up time of the heating roller 31*a*.

The following describes yet another example embodiment of the present invention. As described above, in the fixing unit 11 according to the preceding example embodiment, the external heater 101 contacts the heating roller 31 only while the heating roller 31 stops rotating to effectively transfer heat from the external heater 101 to the heating roller 31. In the standby mode when a sheet S is not conveyed in the fixing unit 11 and heat capacity of the heating roller 31 and the fixing unit 11 increases closer to a saturation level, less power, which is sufficient to maintain the temperature of the heating roller 31 in the standby mode, is supplied to the external heater 101.

When power is not supplied to the external heater 101 in the standby mode, the external heater 101 draws heat from the heating roller 31. To prevent this, e.g., the external heater 101 is configured to contact the heating roller 31 only when power is supplied to the external heater 101. When the external heater 101 contacts the heating roller 31, heat is effectively transferred from the external heater 101 to the heating roller 31. However, when the external heater 101 contacts the heating roller 31 while power is not supplied to the external heater 101 in the standby mode, the external heater 101 may cause the heating roller 31 to radiate heat. To prevent this, e.g., the external heater 101 is configured not to contact the heating roller 31 when power is not supplied to the external heater 101.

When the image forming apparatus 1 or at least the fixing unit 11 is in the standby mode, that is, when power is not supplied to the external heater 101, the external heater 101 separates from the heating roller 31. The contacting-separating signal is output to contact the external heater 101 to the heating roller 31, e.g., only when power is supplied to the external heater 101. When power is supplied to the external heater 101, the contacting-separating signal is continuously output to contact the external heater 101 to the heating roller 31 so that heat is directly transferred from the external heater 101 to the heating roller 31, contacted thereto. When power is not supplied to the external heater 101, output of the contacting-separating signal immediately stops and the external heater 101 moves in a direction in which the external heater 101 separates from the heating roller 31.

In the fixing unit 11 configured as described above, the external heater 101 separates from the heating roller 31 e.g., when power is not supplied to the external heater 101 in the standby mode and contacts the heating roller 31 only when power is supplied to the external heater 101. Thus, when the external heater 101 does not heat the heating roller 31 while power is not supplied to the external heater 101, heat may not be easily transferred from the heating roller 31 to the external heater 101. Namely, heat transfer from the heating roller 31 to the external heater 101 having a greater heat capacity may be suppressed.

When power is not supplied to the external heater 101, that is, when the external heater 101 does not generate heat after the external heater 101, to which power is supplied, heats the heating roller 31, heat may not be radiated from the heating roller 31 to the external heater 101. Thus, heat may be effectively utilized. As a result, power consumed by the external heater 101 to generate heat may be reduced. Further, endurance of the external heater 101 may improve. Specifically, it may take longer for the external heater 101 to be cooled down to a desired temperature. Namely, it may take a long time for the temperature of the external heater 101 to change, resulting in a reduced frequency for supplying power to the external heater 101 to cause the external heater 101 to generate heat.

As described above, this example embodiment may provide effects similar to the effects provided according to the previous example embodiment. Further, when power is not supplied to the external heater 101 and thereby the external heater 101 does not generate heat, the external heater 101 separates from the heating roller 31 to suppress heat transfer from the heating roller 31 to the external heater 101. Namely, heat stored on the heating roller 31 may not easily be transferred to the external heater 101 having the greater heat capacity.

According to this example embodiment, the external heater 101 moves to separate from the heating roller 31 when power is not supplied to the external heater 101. Namely, the external heater 101 is controlled to separate from the heating roller 31 regardless of movement of the heating roller 31, when power is not supplied to the external heater 101. Thus, heat transfer from the heating roller 31 to the external heater 101 may be suppressed while the external heater 101 does not heat the heating roller 31. Namely, heat stored on the heating roller 31 may be transferred to the external heater 101 having the greater heat capacity as little as possible.

Figure 9:
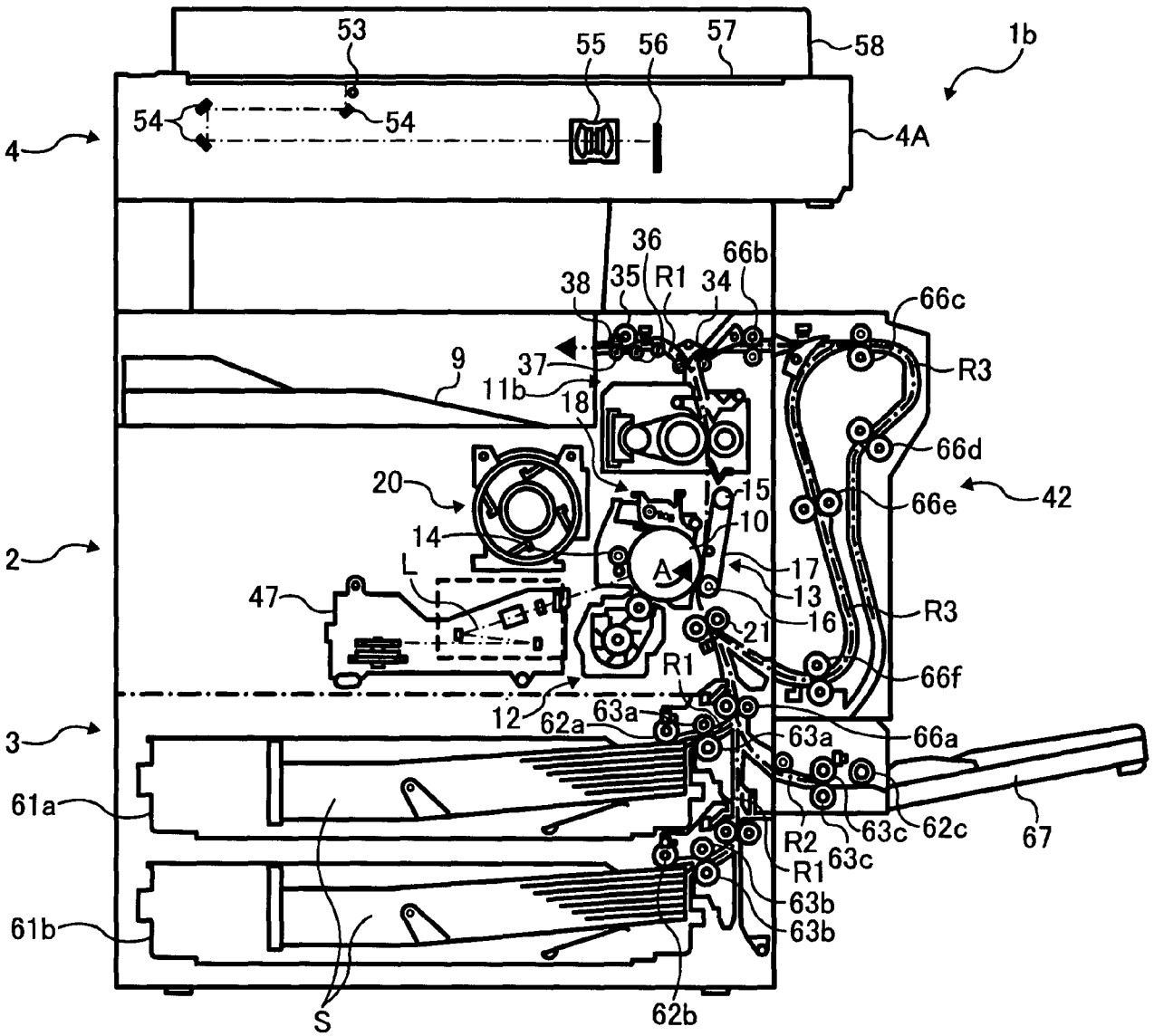
FIG. 9 is a schematic view of an image forming apparatus according to an example embodiment of the present invention.
Figure 10:
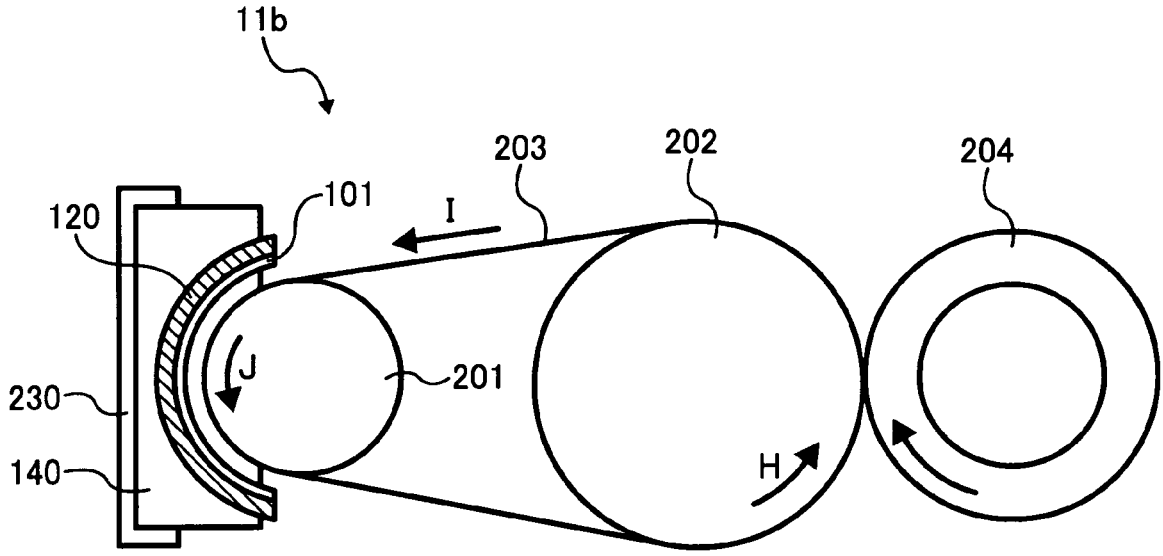
FIG. 10 is a more detailed schematic view (according to an example embodiment of the present invention) of a fixing unit of the image forming apparatus shown in FIG. 9.

FIGS. 9 and 10 illustrate yet another example embodiment of the present invention. As illustrated in FIG. 9, an image forming apparatus 1*b* includes a fixing unit 11*b* instead of the fixing unit 11 illustrated in FIG. 1. The fixing unit 11*b* includes a belt-like shape fixing member for applying heat to a sheet S having a toner image. The other elements of the image forming apparatus 1*b* are common to the image forming apparatus 1 illustrated in FIG. 1.

As illustrated in FIG. 10, the fixing unit 11*b* includes the external heater 101, the heat insulator 120, the resin member 140, a first roller 201, a second roller 202, a fixing belt 203, a pressure roller 204, and/or a unit housing 230.

The fixing belt 203 is looped over the first roller 201 and the second roller 202. The pressure roller 204 opposes the second roller 202 via the fixing belt 203 and functions as a pressing member for applying pressure to the second roller 202 via the fixing belt 203. The external heater 101 is disposed along an outer circumferential surface of the first roller 201 via the fixing belt 203 with a distance provided between the external heater 101 and the fixing belt 203 opposing each other. The external heater 101 is disposed to form a concave-like shape with respect to the outer circumferential surface of the first roller 201 opposing thereto via the fixing belt 203 and does not contact the fixing belt 203. The heat insulator 120 is disposed to contact the outer circumferential surface of the external heater 101, which does not face the fixing belt 203.

In the fixing unit 11*b*, bearings (not shown) rotatably support a shaft of the second roller 202 extended in the horizontal direction. The first roller 201 is disposed away from the second roller 202 with a distance provided between the first roller 201 and the second roller 202 in a substantially horizontal direction. Bearings (not shown) rotatably support a shaft of the first roller 201 extended in the horizontal direction. The bearings of the first roller 201 and the second roller 202 are disposed parallel to each other. The first roller 201 is formed in a hollow cylinder-like shape having a diameter shorter than a diameter of the second roller 202. The fixing belt 203 is looped over the first roller 201 and the second roller 202. The fixing belt 203 is formed in an endless belt shape and functions as a fixing member for applying heat to a sheet S having a toner image. A driver including a motor (not shown) drives and rotates the second roller 202 in a rotating direction H at a constant speed. The rotating second roller 202 drives and rotates the fixing belt 203 in a rotating direction I at a constant speed. The rotating fixing belt 203 drives and rotates the first roller 201 in a rotating direction J.

The pressure roller 204 opposes the second roller 202 via the fixing belt 203. Bearings (not shown) rotatably support a shaft of the pressure roller 204 extended in the horizontal direction. The shaft of the pressure roller 204 may move toward the shaft of the second roller 202 for a distance. A presser (not shown) including the pressing lever 26 illustrated in FIG. 2 presses the pressure roller 204 toward the second roller 202. An outer circumferential surface of the pressure roller 204 contacts a portion on an outer circumferential surface of the fixing belt 203, which is looped over the second roller 202. The outer circumferential surfaces of the pressure roller 204 and the fixing belt 203 contacting each other form a nip (e.g., a fixing position) to which a pressure is applied. A toner image on a sheet S is fixed while the sheet S is conveyed through the nip.

The fixing belt 203 has a width corresponding to a maximum sheet size the image forming apparatus 1*b* may handle. The fixing belt 203 has flexibility and tensile strength needed for a belt as well as heat resistance, thermal conductivity, and compression strength in a thickness direction needed for fixing using heat and pressure. The fixing belt 203 includes a base, an elastic layer, and/or a releasing layer. The base includes a heat resistant resin and has a thickness in a range of from about 30 μm to about 100 μm based on a balance between thermal conductivity and strength. The elastic layer is disposed under the releasing layer and includes a heat resistant rubber (e.g., a silicone rubber and a fluorocarbon rubber) which causes the outer circumferential surface of the fixing belt 203 to uniformly contact a toner image formed on a sheet S. The releasing layer is disposed to cover the elastic layer and includes fluoroplastic which provides releasing and heat resistance properties because the fixing belt 203 pressingly contacts a sheet S and a toner image formed on the sheet S. Thus, the fixing belt 203 rotates to receive heat and stably carry heat to the fixing position.

The external heater 101 is deformed to fit along an outer circumferential surface of the first roller 201. The heat insulator 120 contacts and entirely covers the outer circumferential surface of the external heater 101 which does not face the first roller 201 via the fixing belt 203. The unit housing 230 forms a part of the housing 70 illustrated in FIG. 2. The resin member 140 is attached to the unit housing 230. The external heater 101 and the heat insulator 120 are directly attached to the resin member 140. Thus, the external heater 101 is disposed between the housing 70 and the first roller 201.

As described above, according to this example embodiment, the external heater 101 is disposed along the outer circumferential surface of the first roller 201 via the fixing belt 203 and includes a concave-like shape portion with respect to the outer circumferential surface of the first roller 201 opposing the external heater 101. The external heater 101 does not contact the fixing belt 203 and a distance is uniformly provided between the external heater 101 and the fixing belt 203. Thus, heat may be effectively transferred from the external heater 101 to the fixing belt 203, thereby shortening a warn-up time of the fixing belt 203 and preventing the fixing belt 203 from being cooled down immediately after the fixing belt 203 is warmed up. Further, the outer circumferential surface of the fixing belt 203 may not be damaged.

The external heater 101 is attached to the unit housing 230 via the resin member 140 and is disposed between the unit housing 230 and the heating belt 203, resulting in easy maintenance and space saving in the fixing unit 11*b*.

According to this example embodiment, the fixing unit 11*b* includes the rotatable first roller 201, the rotatable second roller 202, the fixing belt 203 looped over the first roller 201 and the second roller 202, the pressure roller 204 for applying pressure to the second roller 202 via the fixing belt 203, and/or the external heater 101 disposed along the outer circumferential surface of the first roller 201 via the fixing belt 203. The external heater 101 is formed in the concave-like shape with respect to the outer circumferential surface of the first roller 201 so as to heat the fixing belt 203 without contacting the fixing belt 203. The external heater 101 is disposed close to the fixing belt 203 with a uniform distance provided between the external heater 101 and the outer circumferential surface of the fixing belt 203. Thus, heat may be effectively transferred from the external heater 101 to the fixing belt 203. As a result, the fixing belt 203 may be warmed up in a short time period and may not be cooled down immediately after the warm-up is finished. Further, the external heater 101 may not damage the outer circumferential surface of the fixing belt 203.

Figure 11:
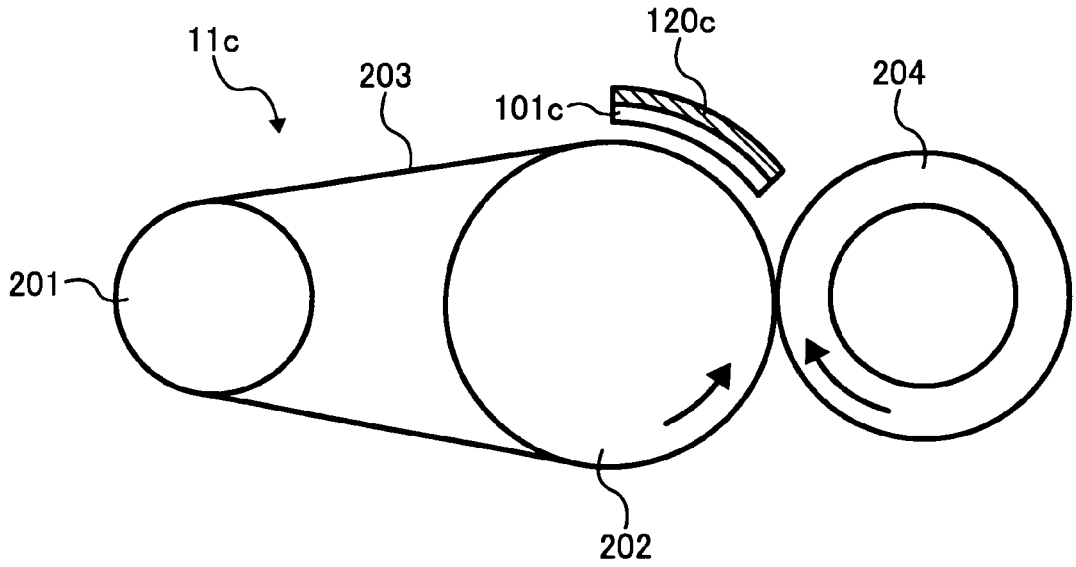
FIG. 11 is a more detailed schematic view of a fixing unit according to an example embodiment of the present invention.

FIG. 11 illustrates a fixing unit 11*c* according to yet another example embodiment of the present invention. As illustrated in FIG. 11, the fixing unit 11*c* includes the first roller 201, the second roller 202, the fixing belt 203, the pressure roller 204, an external heater 101*c*, and/or a heat insulator 120*c*.

The fixing belt 203 is looped over the first roller 201 and the second roller 202. The pressure roller 204 opposes the second roller 202 via the fixing belt 203 and function as a pressing member for applying pressure to the second roller 202 via the fixing belt 203. The external heater 101*c* is disposed along an outer circumferential surface of the second roller 202 via the fixing belt 203 with a distance provided between the external heater 101*c* and the fixing belt 203 opposing each other in a state that the external heater 101*c* does not contact the fixing belt 203. The heat insulator 120*c* is disposed to contact an outer circumferential surface of the external heater 101*c*, which does not face the second roller 202 via the fixing belt 203.

The external heater 101*c* is deformed to fit along the outer circumferential surface of the second roller 202. The heat insulator 120*c* contacts and entirely covers the outer circumferential surface of the external heater 101*c*, which does not face the second roller 202 via the fixing belt 203. The fixing unit 11*c* further includes a unit housing (not shown) and/or a resin member (not shown). The unit housing forms a part of the housing 70 illustrated in FIG. 2. The resin member is attached to the unit housing. The external heater 101*c* and the heat insulator 120*c* are directly attached to the resin member. Thus, the external heater 101*c* is disposed between the housing 70 and the second roller 202.

The structure of each of the external heater 101*c* and the heat insulator 120*c* is common to the external heater 101 and the heat insulator 120 of the fixing unit 11 according to the preceding example embodiment.

As described above, according to this example embodiment, the external heater 101*c* is disposed along the outer circumferential surface of the second roller 202 via the fixing belt 203 and includes a concave-like shape portion with respect to the outer circumferential surface of the second roller 202 opposing the external heater 101*c*. The external heater 101*c* does not contact the fixing belt 203 and a distance is uniformly provided between the external heater 101*c* and the fixing belt 203. Thus, heat may be effectively transferred from the external heater 101*c* to the fixing belt 203, thereby shortening a warm-up time of the fixing belt 203 and preventing the fixing belt 203 from being cooled down immediately after the fixing belt 203 is warmed up. Further, the outer circumferential surface of the fixing belt 203 may not be damaged.

The external heater 101*c* is attached to the unit housing via the resin member and is disposed between the unit housing and the heating belt 203, resulting in easy maintenance and space saving in the fixing unit 11*c*.

According to this example embodiment, the fixing unit 11*c* includes the rotatable first roller 201, the rotatable second roller 202, the fixing belt 203 looped over the first roller 201 and the second roller 202, the pressure roller 204 for applying pressure to the second roller 202 via the fixing belt 203, and/or the external heater 101*c* disposed along the outer circumferential surface of the second roller 202 via the fixing belt 203. The external heater 101*c* is formed in the concave-like shape with respect to the outer circumferential surface of the second roller 202 so as to heat the fixing belt 203 without contacting the fixing belt 203. The external heater 101*c* is disposed close to the fixing belt 203 with a uniform distance provided between the external heater 101*c* and the outer circumferential surface of the fixing belt 203. Thus, heat may be effectively transferred from the external heater 101*c* to the fixing belt 203. As a result, the fixing belt 203 may be warmed up in a short time period and may not be cooled down immediately after the warn-up is finished. Further, the external heater 101*c* may not damage the outer circumferential surface of the fixing belt 203.

Figure 12:
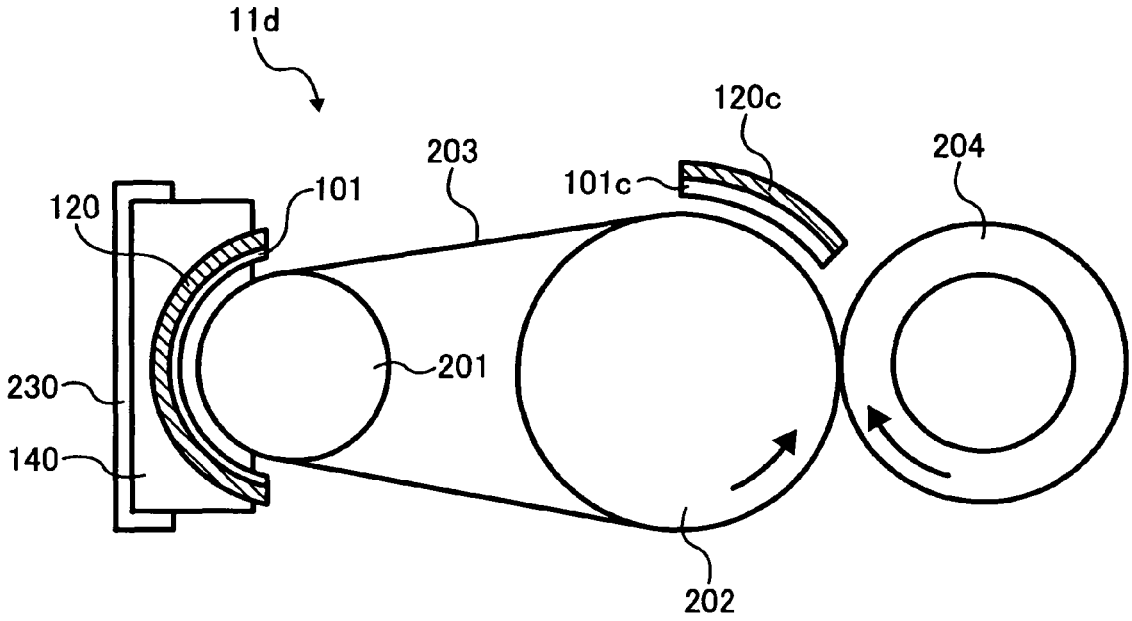
FIG. 12 is a more detailed schematic view of a fixing unit according to an example embodiment of the present invention.

FIG. 12 illustrates a fixing unit 11*d* according to yet another example embodiment of the present invention. As illustrated in FIG. 12, the fixing unit 11*d* includes the external heater 101, the heat insulator 120, the resin member 140, the unit housing 230, the first roller 201, the second roller 202, the fixing belt 203, the pressure roller 204, the external heater 101*c*, and/or the heat insulator 120*c*.

The fixing belt 203 is looped over the first roller 201 and the second roller 202. The pressure roller 204 opposes the second roller 202 via the fixing belt 203 and functions as a pressing member for applying pressure to the second roller 202 via the fixing belt 203. The external heater 101 is disposed along the outer circumferential surface of the first roller 201 via the fixing belt 203 with a distance provided between the external heater 101 and the fixing belt 203 opposing each other in a state that the external heater 101 does not contact the fixing belt 203. The external heater 101 includes a concave-like shape portion with respect to the outer circumferential surface of the first roller 201 opposing the external heater 101. The external heater 101*c* is disposed along the outer circumferential surface of the second roller 202 via the fixing belt 203 with a distance provided between the external heater 101*c* and the fixing belt 203 opposing each other in a state that the external heater 101*c* does not contact the fixing belt 203. The heat insulators 120 and 120*c* are respectively disposed to contact the outer circumferential surfaces of the external heaters 101 and 101*c*, which do not face the fixing belt 203.

Namely, the fixing unit 111*d* includes the external heater 101 and its peripheral elements of the fixing unit 111*b* illustrated in FIG. 10 and the external heater 101*c* and its peripheral elements of the fixing unit 11*c* illustrated in FIG. 11.

As described above, according to this example embodiment, the fixing unit 11*d* includes two external heaters 101 and 101*c*. The external heaters 101 and 101*c* are respectively disposed along the outer circumferential surfaces of the first roller 201 and the second roller 202 via the fixing belt 203 and include a concave-like shape portion with respect to the outer circumferential surfaces of the first roller 201 and the second roller 202 opposing the external heaters 101 and 101*c*. The external heaters 101 and 101*c* do not contact the fixing belt 203 and a distance is uniformly provided between each of the external heaters 101 and 101*c* and the fixing belt 203. Thus, heat may be effectively transferred from the external heaters 101 and 101*c* to the fixing belt 203, thereby shortening a warm-up time of the fixing belt 203 and preventing the fixing belt 203 from being cooled down immediately after the fixing belt 203 is warmed up. Further, the outer circumferential surface of the fixing belt 203 may not be damaged.

According to this example embodiment, two external heaters 101 and 101*c* heat one fixing belt 203. Each of the external heaters 101 and 101*c*, when provided together in the fixing unit 11*d*, may generate heat in a deceased amount and strength compared to when only one of the external heaters 101 and 101*c* is provided, reducing a load applied to each of the external heaters 101 and 101*c* and thereby improving endurance of each of the external heaters 101 and 101*c*. Further, the external heaters 101 and 101*c* may stably heat the fixing belt 203 with high precision, resulting in improved control of the fixing temperature. Thus, the fixing unit 11*d* may provide improved fixing performance.

The external heater 101 is provided between the unit housing 230 and the fixing belt 203 and the external heater 101*c* is provided between the unit housing (not shown) having a common structure to the unit housing of the fixing unit 11*c* illustrated in FIG. 11 and the fixing belt 203, resulting in space saving in the fixing unit 11*d*. The external heaters 101 and 101*c* are respectively attached to the unit housing 230 and the unit housing (not shown), resulting in easy maintenance and space saving in the fixing unit 11*d*.

According to this example embodiment, the fixing unit 11*d* includes the rotatable first roller 201, the rotatable second roller 202, the fixing belt 203 looped over the first roller 201 and the second roller 202, the pressure roller 204 for applying pressure to the second roller 202 via the fixing belt 203, and/or two external heaters 101 and 101*c* respectively disposed along the outer circumferential surfaces of the first roller 201 and the second roller 202 via the fixing belt 203. The external heaters 101 and 101*c* are respectively formed in the concave-like shape with respect to the outer circumferential surfaces of the first roller 201 and the second roller 202 so as to heat the fixing belt 203 without contacting the fixing belt 203. Each of the external heaters 101 and 101*c* is disposed close to the fixing belt 203 with a uniform distance provided between each of the external heaters 101 and 101*c* and the outer circumferential surface of the fixing belt 203. Thus, heat may be effectively transferred from the external heaters 101 and 101*c* to the fixing belt 203. As a result, the fixing belt 203 may be warmed up in a short time period and may not be cooled down immediately after the warm-up is finished. Further, the external heaters 101 and 101*c* may not damage the outer circumferential surface of the fixing belt 203.

Figure 13:
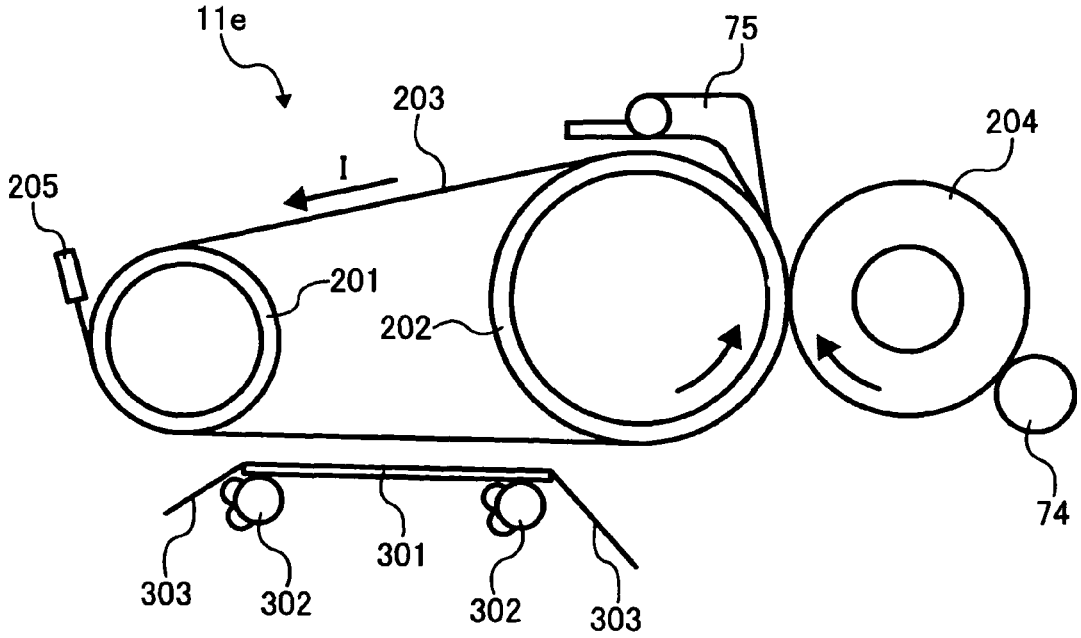
FIG. 13 is a schematic view of a fixing unit according to an example embodiment of the present invention.

FIG. 13 illustrates a fixing unit 11*e* according to yet another example embodiment of the present invention. As illustrated in FIG. 13, the fixing unit 11*e* includes the first roller 201, the second roller 202, the fixing belt 203, the pressure roller 204, the cleaner 74, the separating nail 75, an external heater 301, cam shafts 302, tension belts 303, and/or a temperature sensor 205.

The fixing belt 203 is looped over the first roller 201 and the second roller 202 and rotates in the rotating direction I. The pressure roller 204 opposes the second roller 202 via the fixing belt 203 and functions as a pressing member for applying pressure to the second roller 202 via the fixing belt 203. The external heater 301 is disposed along the outer circumferential surface of the fixing belt 203 with a distance provided between the external heater 301 and the fixing belt 203 opposing each other in a state that the external heater 301 does not contact the fixing belt 203. The cam shafts 302 are formed in a cam shape and are disposed to contact both ends in the rotating direction I on an outer circumferential surface of the external heater 301, which does not face the fixing belt 203. The cam shafts 302 are not formed in a uniform shape in cross section. Namely, the cam shafts 302 do not have a uniform shape in cross section in a longitudinal direction of the cam shafts 302 and are not formed in a uniformly-round bar shape. The tension belts 303 pull both edges of the external heater 301 in the rotating direction I.

The external heater 301 faces a flat portion on the outer circumferential surface of the fixing belt 203, which is formed between the first roller 201 and the second roller 202 and extends straight for a length in the rotating direction I. In an initial state, the cam shafts 302 support the external heater 301 in a state that an inner circumferential surface of the external heater 301 faces the entire flat portion on the outer circumferential surface of the fixing belt 203 with a distance uniformly provided between the external heater 301 and the fixing belt 203 opposing each other. The external heater 301 may be flexibly deformed. The cam shafts 302 may be rotated through an angle. Thus, the external heater 301 may be entirely moved closer to the flat portion on the outer circumferential surface of the fixing belt 203. Otherwise, a substantially center portion on the inner circumferential surface of the external heater 301 in a width direction (e.g., a direction perpendicular to the rotating direction I) of the external heater 301, which extends in a longitudinal direction (e.g., the rotating direction I) of the external heater 301 between the cam shafts 302 may be moved closer to the flat portion on the outer circumferential surface of the fixing belt 203. In this case, portions other than the substantially center portion on the inner circumferential surface of the external heater 301 may be positioned away from the flat portion on the outer circumferential surface of the fixing belt 203.

The temperature sensor 205 includes a terminal disposed to contact the outer circumferential surface of the fixing belt 203 to detect a temperature of the outer circumferential surface of the fixing belt 203.

Figure 14A:
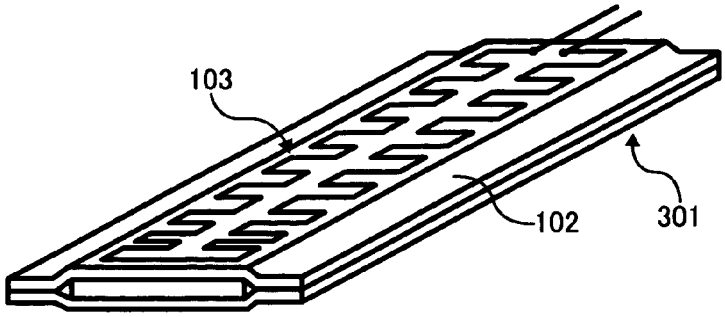
FIG. 14A is a perspective view (according to an example embodiment of the present invention) of an external heater for the fixing unit shown in FIG. 13.
Figure 14B:
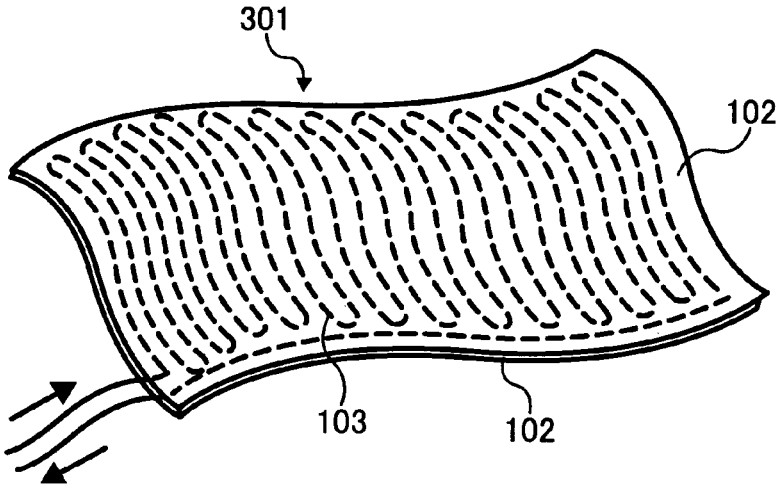
FIG. 14B is a perspective view (according to an example embodiment of the present invention) of another external heater for the fixing unit shown in FIG. 13.

As illustrated in FIGS. 14A and 14B, the external heater 301 includes a heat-resistant resin sheet 102 and/or a heat generator 103. The heat-resistant resin sheet 102 is formed in a sheet-like shape and includes a polyimide film having a thickness in a range of from about 0.5 mm to about 1.0 mm. The heat generator 103 is buried in the heat-resistant resin sheet 102. The heat generator 103 includes an electrode and an external terminal crimped to the electrode. Specifically, the external terminal is connected to the electrode by crimping. FIG. 14A illustrates the heat generator 103 disposed on the entire surface of the heat-resistant resin sheet 102. The external heater 301 illustrated in FIG. 14A has a structure common to the external heater 101 illustrated in FIG. 4A. FIG. 14B illustrates the heat generator 103 linearly disposed in the heat-resistant resin sheet 102. When the temperature of the external heater 301 reaches a reference temperature (which may be based, e.g., upon a resistance suitable for the heat generator 103), the heat generator 103 may be controlled to stop generating heat and thereby the temperature of the external heater 301 does not exceed the reference temperature. Thus, a thermostat, a thermal fuse, and/or a temperature controller may be eliminated.

Figure 15:
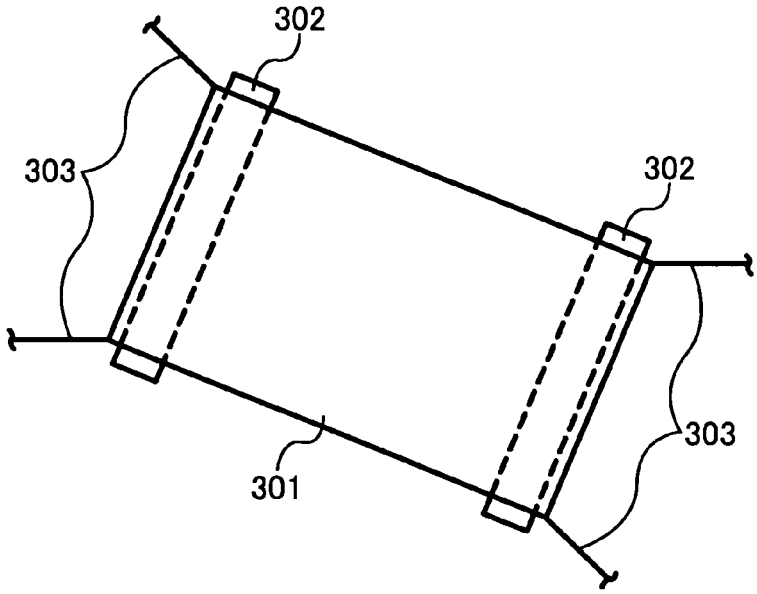
FIG. 15 is a schematic view of the external heater, cam shafts, and tension belts of the fixing unit shown in FIG. 13.

As illustrated in FIG. 15, the tension belts 303 apply a tension for pressing the external heater 301 toward the cam shafts 302. The external heater 301 may be deformed in accordance with the shape of the cam shafts 302. The cam shafts 302 do not have a uniform shape in cross section in a sub-scanning direction (e.g., the longitudinal direction of the cam shafts 302). Therefore, the entire surface of the external heater 301 or the center portion on the surface of the external heater 301 in the width direction of the external heater 301 may be selectively positioned close to the outer circumferential surface of the fixing belt 203 by rotating the cam shafts 302.

As illustrated in FIGS. 13 and 15, the tension belts 303 continuously apply a tension to the external heater 301 so that outer edges of the external heater 301 are pulled obliquely downward as illustrated in FIG. 13 and stretched outward as illustrated in FIG. 15. Thus, the external heater 301 is deformed in accordance with the outer shape of the cam shafts 302 in the longitudinal direction of the cam shafts 302. Bearings (not shown) support the cam shafts 302 in the fixing unit 11*e*. A driver (not shown) including a motor drives and rotates the cam shafts 302 through an angle in a rotating direction. The cam shafts 302 may stop at an arbitrary angle. The ends of the tension belts 303, which may be elastically stretched, are fixed in the fixing unit 11*e*. Otherwise, the ends of the tension belts 303 are fixed in the fixing unit 11*e* by using elastic members (e.g., springs) which may be elastically stretched.

Figure 16A:
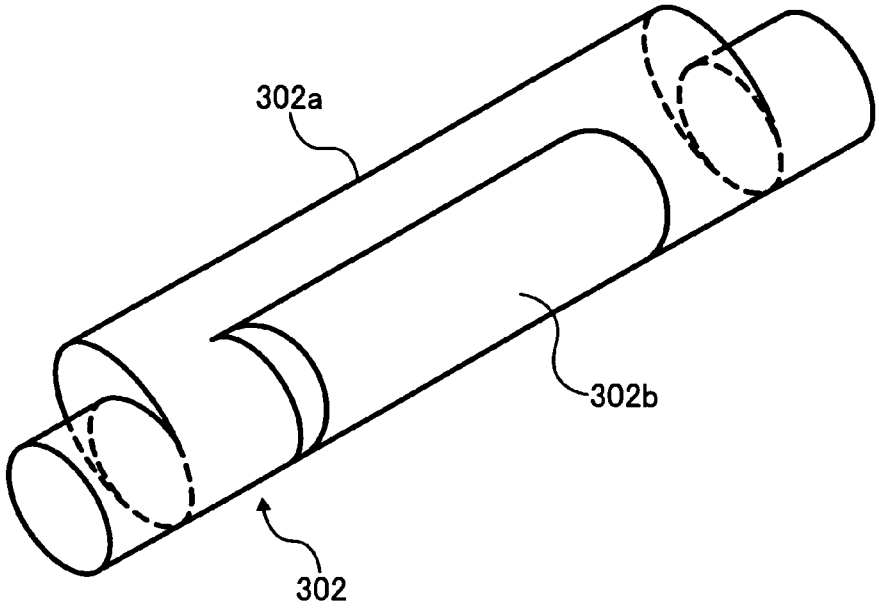
FIG. 16A is a more detailed perspective view (according to an example embodiment of the present invention) of the cam shaft shown in FIG. 15.
Figure 16B:
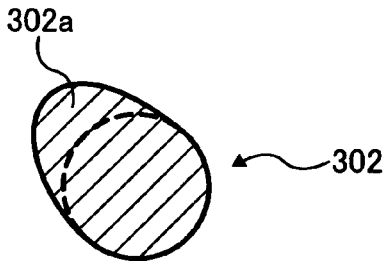
FIG. 16B is a sectional view of the cam shaft shown in FIG. 16A.
Figure 16C:
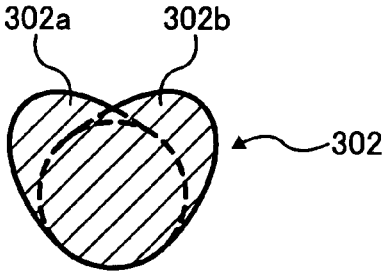
FIG. 16C is another sectional view of the cam shaft shown in FIG. 16A.

The two cam shafts 302 are formed in a common shape having a sufficient strength. As illustrated in FIGS. 16A, 16B, and 16C, the cam shaft 302 includes a first ridge 302*a* and/or a second ridge 302*b*. The first ridge 302*a* is formed along the longitudinal direction of the cam shaft 302 and uniformly protrudes for a length in a radial direction of the cam shaft 302. The second ridge 302*b* protrudes for a length in the radial direction of the cam shaft 302 at an angle shifted for about 90 degrees from the first ridge 302*a*. The center portion of the second ridge 302*b* in the longitudinal direction of the cam shaft 302 protrudes for a length common to the first ridge 302*a*.

When at least sheet size is automatically or manually selected, the cam shafts 302 are driven and rotated through an angle in a rotating direction so that either the first ridge 302*a* or the second ridge 302*b* supports the surface of the external heater 301 in accordance with the size of a sheet S. Thus, either the first ridge 302*a* or the second ridge 302*b* may protrude for a length longer than a length for which any other part on the outer circumferential surface of the cam shaft 302 protrudes toward the flat outer circumferential surface of the fixing belt 203, which opposes the external heater 301. The surface of the external heater 301 entirely or partially moves close to the flat outer circumferential surface of the fixing belt 203 in accordance with the sheet size selected. Thus, variations in the temperature of the outer circumferential surface of the fixing belt 203 may be suppressed.

Specifically, when a small size sheet S is conveyed through the nip formed between the pressure roller 204 and the fixing belt 203, the small size sheet S contacts and draws heat from a center portion on the outer circumferential surface of the fixing belt 203 in the width direction of the fixing belt 203. As a result, the temperature of the outer circumferential surface of the fixing belt 203 may vary in the width direction of the fixing belt 203. To reduce if not prevent this, the cam shafts 302 cause the center portion on the surface of the external heater 301 in the width direction of the external heater 301 to move close to the center portion on the outer circumferential surface of the fixing belt 203.

To control the external heater 301 to operate as described above, a control circuit (not shown) may be provided in the fixing unit 11*e*. Otherwise, a controller (not shown) of the image forming apparatus 1*b* may be utilized. The control circuit and the controller may be connected to various sensors and switches used for controlling the external heater 301 to obtain signals from the sensors and switches. The control circuit and the controller may also be connected to the external heater 301 to send commands to the external heater 301.

In the fixing unit 11*e*, the external heater 301 heats a portion on the outer circumferential surface of the fixing belt 203 without contacting the fixing belt 203 immediately before the portion on the outer circumferential surface of the fixing belt 203 reaches the nip formed between the pressure roller 204 and the fixing belt 203, providing improved heating efficiency. Specifically, the external heater 301 heats the portion on the outer circumferential surface of the fixing belt 203, which rotates near and upstream of the nip formed between the pressure roller 204 and the fixing belt 203 in the rotating direction I without contacting the portion on the outer circumferential surface of the fixing belt 203. A distance for which the heated portion moves until reaching the nip formed between the pressure roller 204 and the fixing belt 203 may be shortened, preventing or reducing heat transferred from the heated fixing belt 203 to elements other than the second roller 202. Thus, the improved heating efficiency may provide a small size external heater 301 and reduced power consumption of the fixing unit 11*e*.

As described above, according to this example embodiment, the external heater 301 is disposed along the outer circumferential surface of the fixing belt 203 and is formed in a shape for heating the fixing belt 203 along the outer circumferential surface of the fixing belt 203 without contacting the outer circumferential surface of the fixing belt 203. Thus, the external heater 301 may not damage the outer circumferential surface of the fixing belt 203. The external heater 301 moves close to the fixing belt 203 to effectively transfer heat to the fixing belt 203, shortening the warn-up time of the fixing belt 203 and preventing the temperature of the fixing belt 203 from decreasing immediately after the warm-up is finished.

A distance between the entire or partial surface of the external heater 301 and the fixing belt 203 may be arbitrarily changed in accordance with the size of a sheet S, suppressing variations in the temperature of the outer circumferential surface of the fixing belt 203 in the width direction of the fixing belt 203 after a small size sheet S is conveyed through the nip formed between the pressure roller 204 and the fixing belt 203. Thus, the outer circumferential surface of the fixing belt 203 may be uniformly heated in the width direction of the fixing belt 203, improving fixing performance.

A heat insulator may be attached to the external heater 301 to obtain effects provided by the heat insulator 120 of the fixing unit 11. In this case, for example, the heat insulator may have a structure common to the heat insulator 120 but may have a thickness for not preventing deformation of the external heater 301 in accordance with the size of a sheet S. The heat insulator may cover a portion on the outer circumferential surface of the external heater 301, which does not face the fixing belt 203 and does not contact the cam shafts 302.

According to this example embodiment, the distance between the external heater 301 and the fixing belt 203 may be changed in the sub-scanning direction. The external heater 301 is disposed along the outer circumferential surface of the fixing belt 203 so as to heat the fixing belt 203 without contacting the fixing belt 203. The external heater 301 is disposed close to the fixing belt 203 to effectively transfer heat from the external heater 301 to the fixing belt 203 without damaging the outer circumferential surface of the fixing belt 203. As a result, the fixing belt 203 may be warmed up in a short time period and may not be cooled down immediately after the warm-up of the fixing belt 203 is finished. The distance between the external heater 301 and the fixing belt 203 may be arbitrarily changed in accordance with the size of a sheet S. Thus, even after a small size sheet S contacts the fixing belt 203 for fixing, the temperature of the fixing belt 203 may not vary in the width direction of the fixing belt 203.

The cam shafts 302 are disposed on the outer circumferential surface of the external heater 301, which does not face the fixing belt 203, to adjust the distance between the external heater 301 and the fixing belt 203. The cam shafts 302 have the non-uniform shape in cross section in the sub-scanning direction. The cam shafts 302 support the external heater 301 in a state that the tension belts 303 pull the outer edges of the external heater 301. Thus, the distance between the external heater 301 and the fixing belt 203 may be changed with a simple structure to suppress variations in the temperature of the fixing belt 203 in the width direction of the fixing belt 203.

According to the example embodiments as described above, the external heaters 101, 101*a*, 101*c*, and 301 include the heat-resistant resin sheet 102 and the heat generator 103 buried in the heat-resistant resin sheet 102. The external heaters 101, 101*a*, 101*c*, and 301 are formed in the sheet-like shape having the thickness not greater than about 1 mm. Thus, the external heaters 101, 101*a*, 101*c*, and 301 may save space in the fixing units 11, 11*a*, 11*b*, 11*c*, 11*d*, and 11*e*.

The external heaters 101, 101*a*, 101*c*, and 301 may be deformed. Therefore, the external heaters 101, 101*a*, 101*c*, and 301 may be disposed along the outer circumferential surface of the fixing member so as to effectively transfer heat from the external heaters 101, 101*a*, 101*c*, and 301 to the fixing member. The external heaters 101, 101*a*, 101*c*, and 301 may be disposed in the limited space to save space in the fixing units 11, 11*a*, 11*b*, 11*c*, 11*d*, and 11*e*. Namely, the external heaters 101, 101*a*, 101*c*, and 301 may be deformed into an arbitrary shape which fits the portion on the outer circumferential surface of the fixing member, to which the external heaters 101, 101*a*, 101*c*, and 301 oppose. The deformed external heaters 101, 101*a*, 101*c*, and 301 are disposed along the portion on the outer circumferential surface of the fixing member, to which the external heaters 101, 101*a*, 101*c*, and 301 oppose. Thus, the external heaters 101, 101*a*, 101*c*, and 301 may be disposed in the fixing units 11, 11*a*, 11*b*, 11*c*, 11*d*, and 11*e* by occupying a reduced space.

The external heaters 101, 101*a*, 101*c*, and 301 include the heat insulator 120, including the core and the cover, produced by covering the core with the cover in vacuum. Therefore, the heat insulator 120 may have the thin shape. The thin heat insulator 120 may be disposed in the limited space in the fixing units 11, 11*a*, 11*b*, 11*c*, 11*d*, and 11*e* by occupying a reduced space.

The fixing units 11, 11*a*, 11*b*, 11*c*, 11*d*, and 11*e* include the movable housing 130 or the unit housing 230. The external heaters 101, 101*a*, 101*c*, and 301 are disposed between the movable housing 130 or the unit housing 230 and the fixing member, saving space in the fixing units 11, 11*a*, 11*b*, 11*d*, and 11*e*.

The movable housing 130 or the unit housing 230 supports the external heaters 101, 101*a*, 101*c*, and 301 and the heat insulator 120, resulting in easy maintenance and space saving in the fixing units 11, 11*a*, 11*b*, 11*c*, 11*d*, and 11*e*.

The image forming apparatuses 1 and 1*b* include the fixing unit 11, 11*a*, 11*b*, 11*c*, 11*d*, or 11*e*, and thereby provide the above-described effects and improved fixing performance.

According to the above-described example embodiments, the external heater 101 of the fixing unit 11*b*, the external heater 101*c* of the fixing unit 11*c*, and the external heater 101*d* of the fixing unit 11*d* are not configured to move, but may be configured to move to contact and separate from the fixing belt 203 like the external heater 101 of the fixing unit 11 and to include one or more controls of the fixing units 11 and 11*a*. When the external heater 101 of the fixing unit 11*b*, the external heater 101*c* of the fixing unit 11*c*, or the external heater 101*d* of the fixing unit 11*d* is configured to contact the fixing belt 203, the surface of the external heater 101, 101*c*, or 101*d* which contacts the surface of the fixing belt 203 may be formed in a shape corresponding to the outer circumferential surface of the fixing belt 203 so that the entire surface of the external heater 101, 101*c*, or 101*d* may contact the outer circumferential surface of the fixing belt 203, like the external heater 101*a* of the fixing unit 11*a*.

According to the above-described example embodiment, the external heater 301 of the fixing unit 11*e* is configured to move close to the fixing belt 203 without contacting the fixing belt 203 by using the cam shafts 302, but may be configured to entirely contact the fixing belt 203 and to include one or more controls of the fixing units 11*b*, 11*c*, and 11*d*.

In the fixing units 11, 11*a*, 11*b*, 11*c*, 11*d*, and 11*e*, the heaters (e.g., the external heaters 101, 101*a*, 101*c*, and 301) are disposed outside the fixing members (e.g., the heating rollers 31 and 31*a* and the fixing belt 203). However, an auxiliary heater for heating the fixing member together with the heater may be disposed inside the fixing member. For example, when the heating roller 31 or 31*a* is used as the fixing member, the heating roller 31 or 31*a* may have a thin thickness and may include a material for effectively transferring heat from an inner circumferential surface to an outer circumferential surface of the heating roller 31 or 31*a*. The auxiliary heater (e.g., an electric heater and a halogen lamp) may be disposed inside the heating roller 31 or 31*a* without contacting the inner circumferential surface of the heating roller 31 or 31*a*. When the fixing belt 203 is used as the fixing member, at least one of the pair of rollers (e.g., the first roller 201 and the second roller 202), over which the fixing belt 203 is looped, may have a structure similar to the structure of the heating roller 31 or 31*a* as described above and the auxiliary heater (e.g., an electric heater and a halogen lamp) may be disposed inside the at least one of the pair of rollers like the heating roller 31 or 31*a* as described above.

In the fixing units 11, 11*a*, 11*b*, 11*c*, 11*d*, and 11*e*, the fixing members (e.g., the heating rollers 31 and 31*a* and the fixing belt 203) and the pressing members (e.g., the pressure rollers 32 and 204) are disposed to oppose each other in the horizontal direction. However, the fixing member and the pressing member may be disposed to oppose each other in a vertical direction. For example, the pressing member may be disposed lower than the fixing member to oppose the fixing member. A sheet S having a toner image may be conveyed through a nip formed between the fixing member and the pressing member in a substantially horizontal direction.

In the image forming apparatuses 1 and 1*b*, a toner image formed on the photoconductor 10 is transferred onto a sheet S. However, the toner image formed on the photoconductor 10 may be transferred onto an intermediate transferor (e.g., an intermediate transfer belt) and then transferred from the intermediate transferor to the sheet S. The sheet S may include paper, cloth, a plastic sheet, and an OHP transparency, which is formed in a sheet-like shape, as long as the sheet S may carry the toner image formed thereon and the fixing operation may be performed on the sheet S having the toner image.

The present invention has been described above with reference to specific example embodiments. Nonetheless, the present invention is not limited to the details of the example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present patent invention.

What is claimed is:

1. An image forming apparatus, the apparatus comprising:

an image forming mechanism to form a toner image on a recording medium according to image data; and a fixing mechanism to fix the toner image on the recording medium, the fixing mechanism including a fixing member to apply heat to the recording medium having the toner image, and a movable external heater configured to move at least one of towards and away from the fixing member to heat the fixing member, the movable external heater being formed in a shape corresponding to a surface of the fixing member, the movable external heater being further configured to at least one of engage and be spaced apart from the fixing member by a distance which is variable according to movement of the movable external heater, the movable external heater being configured to maintain the shape corresponding to the surface of the fixing member regardless as to whether the movable external heater engages or is spaced apart from the fixing member.

2. The image forming apparatus according to claim 1, wherein the distance is reduced to zero so that the movable external heater contacts the fixing member when the fixing member stops and the distance is non-zero so that the movable external heater separates from the fixing member when the fixing member moves.

3. The image forming apparatus according to claim 1, wherein the fixing member includes a convex-like shape portion and the movable external heater includes a concave-like shape portion including an arc corresponding to the convex-like shape portion of the fixing member, and wherein the concave-like shape portion of the movable external heater contacts the convex-like shape portion of the fixing member.

4. The image forming apparatus according to claim 1, wherein the distance is reduced to zero so that the movable external heater contacts the fixing member after the fixing member stops moving and the distance is non-zero so that the movable external heater separates from the fixing member before the fixing member starts moving.

5. The image forming apparatus according to claim 1, wherein the distance is reduced to zero so that the movable external heater contacts the fixing member when the image forming apparatus is powered off.

6. The image forming apparatus according to claim 1, wherein the distance is non-zero such that the movable external heater separates from the fixing member when power is not supplied to the movable external heater.

7. The image forming apparatus according to claim 1, wherein the distance is changed in a sub-scanning direction.

8. The image forming apparatus according to claim 7, wherein the fixing mechanism further includes at least one cam to change the distance, the cam being disposed on a surface of the movable external heater, which does not face the fixing member.

9. The image forming apparatus according to claim 8, wherein the cam includes a non-uniform shape in cross section in the sub-scanning direction.

10. The image forming apparatus according to claim 8, wherein the fixing mechanism further includes at least one belt to pull edges of the external heater to tension the external heater supported by the cam.

11. The image forming apparatus according to claim 1, wherein the fixing mechanism further includes first and second rollers over which the fixing member is looped and a pressing member to apply pressure to the second roller via the fixing member, and wherein the fixing member is formed in a belt-like shape and the movable external heater is disposed along an outer circumferential surface of one of the first and second rollers via the fixing member without contacting the fixing member so as to have a concave-like shape with respect to the outer circumferential surface of the one of the first and second rollers.

12. The image forming apparatus according to claim 11, wherein the fixing mechanism further includes one more external heaters disposed along the outer circumferential surface of the other one of the first and second rollers via the fixing member without contacting the fixing member so as to have a concave-like shape with respect to the outer circumferential surface of the other one of the first and second rollers.

13. The image forming apparatus according to claim 1, wherein the movable external heater includes a sheet member and a heat generator buried in the sheet member.

14. The image forming apparatus according to claim 1, wherein the movable external heater is formed in a sheet-like shape having a thickness not greater than about 1 mm.

15. The image forming apparatus according to claim 1, wherein the movable external heater is deformed.

16. The image forming apparatus according to claim 1, wherein the fixing mechanism further includes a heat insulator including a core and a cover and produced by covering the core with the cover in vacuum.

17. The image forming apparatus according to claim 16, wherein the fixing mechanism further includes a unit housing disposed to sandwich the movable external heater together with the fixing member.

18. The image forming apparatus according to claim 17, wherein the movable external heater and the heat insulator are supported by the unit housing.

19. The image forming apparatus of claim 1, wherein the movable external heater is configured to heat the fixing member by conduction and radiation.

20. The image forming apparatus of claim 1, wherein the fixing mechanism further includes a biasing device configured to move the movable external heater towards the fixing member and a moving device configured to move the movable external heater away from the fixing member.

21. The image forming apparatus of claim 20, wherein the biasing device is a spring and the moving device is a cam operatively connected to a motor.

22. The image forming apparatus of claim 21, wherein the cam is oval shaped.

23. A fixing unit for fixing a toner image on a recording medium, the fixing unit comprising:

a fixing member to apply heat to the recording medium having the toner image; and a movable external heater configured to move at least one of towards and away from the fixing member to heat the fixing member, the movable external heater being formed in a shape corresponding to a surface of the fixing member, the movable external heater being further configured to at least one of engage and be spaced apart from the fixing member by a distance which is variable according to movement of the movable external heater, the movable external heater being configured to maintain the shape corresponding to the surface of the fixing member regardless as to whether the movable external heater engages or is spaced apart from the fixing member.

24. An image forming method comprising:

forming a toner image on a recording medium according to image data; and fixing the toner image on the recording medium, the fixing step including disposing an external heater formed in a shape corresponding to a surface of a fixing member as if to engage the fixing member and yet be spaced apart from, the external heater being configured to maintain the shape regardless as to whether the external heater is engaged with the fixing member or spaced apart therefrom, moving the external heater to be a desired distance apart from the fixing member, heating the fixing member with the external heater, and applying heat to the recording medium having the toner image.

* * * * *